US012181226B2

(12) United States Patent
Nilsson et al.

(10) Patent No.: US 12,181,226 B2
(45) Date of Patent: Dec. 31, 2024

(54) HEAT TRANSFER PLATE AND GASKET

(71) Applicant: ALFA LAVAL CORPORATE AB, Lund (SE)

(72) Inventors: Johan Nilsson, Ronneby (SE); Jenny Rasmussen, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 18/557,176

(22) PCT Filed: Apr. 1, 2022

(86) PCT No.: PCT/EP2022/058769
§ 371 (c)(1),
(2) Date: Oct. 25, 2023

(87) PCT Pub. No.: WO2022/228826
PCT Pub. Date: Nov. 3, 2022

(65) Prior Publication Data

US 2024/0219124 A1 Jul. 4, 2024

(30) Foreign Application Priority Data

Apr. 27, 2021 (EP) ..... 21170710

(51) Int. Cl.
*F28D 9/00* (2006.01)
*F28F 3/10* (2006.01)

(52) U.S. Cl.
CPC ..... *F28D 9/005* (2013.01); *F28F 3/10* (2013.01); *F28F 2230/00* (2013.01)

(58) Field of Classification Search
CPC ..... F28F 3/10; F28D 9/005
See application file for complete search history.

(56) References Cited

U.S. PATENT DOCUMENTS 3,532,161 A 10/1970 Loebel
4,432,415 A * 2/1984 Wright ..... F16J 15/104 165/166

(Continued)

FOREIGN PATENT DOCUMENTS

CN 100449251 C 1/2009
CN 102393155 A 3/2012

(Continued)

OTHER PUBLICATIONS

International Search Report (PCT/ISA/210) and Written Opinion (PCT/ISA/237) mailed on Sep. 8, 2022, by the European Patent Office as the International Searching Authority for International Application No. PCT/EP2022/058769.

(Continued)

*Primary Examiner* — Jianying C Atkisson
*Assistant Examiner* — For K Ling
(74) *Attorney, Agent, or Firm* — BUCHANAN INGERSOLL & ROONEY PC

(57) ABSTRACT

A heat transfer plate has a front gasket groove including an annular front groove part extending around a heat transfer area, upper and lower distribution areas, and first and third portholes, and second and fourth ring groove parts enclosing second and fourth portholes. An upper front groove portion of the front gasket groove extends between the second porthole and the upper distribution area. A lower front groove portion of the front gasket groove extends between the fourth porthole and the lower distribution area. A bottom of the upper front groove portion is inclined such that the front gasket groove depth, within the upper front groove portion, increases in a direction towards the second adiabatic area, and a bottom of the lower front groove portion is inclined such that the front gasket groove depth, within the (Continued)

lower front groove portion, increases in a direction towards the fourth adiabatic area.

15 Claims, 10 Drawing Sheets

(56) References Cited

U.S. PATENT DOCUMENTS

| | | | | | |
|---|---|---|---|---|---|
| 4,646,821 | A * | 3/1987 | Almqvist | F28F 3/10 | 165/166 |
| 5,193,612 | A * | 3/1993 | Stirnkorb | F28F 3/10 | 165/70 |
| 5,443,115 | A * | 8/1995 | Pedersen | F28F 3/083 | 165/70 |
| 6,131,648 | A * | 10/2000 | Rasmussen | F28F 3/10 | 165/145 |
| 7,490,660 | B2 * | 2/2009 | Song | F28F 3/10 | 165/166 |
| 9,829,259 | B2 | 11/2017 | Nyander et al. | | |
| 2008/0196873 | A1 | 8/2008 | Svensson | | |
| 2009/0159251 | A1 * | 6/2009 | Blomgren | F28F 3/083 | 165/167 |
| 2014/0034276 | A1 * | 2/2014 | Persson | F16J 15/062 | 165/167 |
| 2019/0154347 | A1 * | 5/2019 | Andersen | F28F 3/10 | |
| 2020/0278158 | A1 | 9/2020 | Nilsson et al. | | |

FOREIGN PATENT DOCUMENTS

| | | | | |
|---|---|---|---|---|
| DE | 3616745 | A1 | 11/1987 | |
| EP | 1047913 | B1 | 8/2003 | |
| EP | 3467423 | A1 | 4/2019 | |
| EP | 3650795 | A1 | 5/2020 | |
| EP | 3660436 | A1 | 6/2020 | |
| JP | H06065777 | U | 9/1994 | |
| JP | H1096595 | A | 4/1998 | |
| JP | H10267583 | A | 10/1998 | |
| JP | 2008528927 | A | 7/2008 | |
| KR | 1020150079854 | A | 7/2015 | |
| KR | 102143827 | B1 | 8/2020 | |
| RU | 2037120 | C1 | 6/1995 | |
| RU | 2100733 | C1 | 12/1997 | |
| TW | 201923301 | A | 6/2019 | |
| WO | WO-9935457 | A1 * | 7/1999 | F28F 3/10 |
| WO | 2006080874 | A1 | 8/2006 | |
| WO | 2009080565 | A1 | 7/2009 | |
| WO | 2014067674 | A1 | 5/2014 | |

OTHER PUBLICATIONS

Office Action (Notice of Preliminary Rejection) issued on Mar. 8, 2024, in corresponding Korean Patent Application No. 10-2023-7040389 and English translation of the Office Action. (9 pages).

Office Action (Notification to Grant Patent Right for Invention) issued on Feb. 4, 2024, in corresponding Chinese Patent Application No. 202280031271.6 and English translation of the Office Action. (7 pages).

* cited by examiner

Section A-A

Section B-B

Section C-C

Section D-D

HEAT TRANSFER PLATE AND GASKET

TECHNICAL FIELD

The invention relates to a heat transfer plate and a gasket for such a heat transfer plate.

BACKGROUND ART

Plate heat exchangers, PHEs, typically comprises two end plates in between which a number of heat transfer plates are arranged in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called gasketed PHEs, gaskets are arranged between the heat transfer plates in gasket grooves pressed in the heat transfer plates. The end plates, and therefore the heat transfer plates, are pressed towards each other by some kind of tightening means, whereby the gaskets seal between the heat transfer plates. Parallel flow channels are formed between the heat transfer plates, one channel between each pair of adjacent heat transfer plates. Two fluids of initially different temperatures, which are fed to/from the PHE through inlets/outlets, can flow alternately through every second channel for transferring heat from one fluid to the other, which fluids enter/exit the channels through inlet/outlet portholes in the heat transfer plates communicating with the inlets/outlets of the PHE.

Typically, a heat transfer plate comprises two end portions and an intermediate heat transfer portion. The end portions comprise the inlet and outlet portholes, distribution areas pressed with a distribution pattern of ridges and valleys, and intermediate adiabatic areas pressed with an adiabatic pattern of ridges and valleys. Similarly, the heat transfer portion comprises a heat transfer area pressed with a heat transfer pattern of ridges and valleys. The ridges and valleys of the distribution, adiabatic and heat transfer patterns of the heat transfer plate are arranged to contact, in contact areas, the ridges and valleys of distribution, adiabatic and heat transfer patterns of adjacent heat transfer plates in a plate heat exchanger. The main task of the adiabatic areas is to convey fluids entering the channels to the distribution areas, and to convey the fluids from the distribution areas out of the channels. The main task of the distribution areas of the heat transfer plates is to spread the fluids across the width of the heat transfer plates before the fluids reach the heat transfer areas, and to collect the fluids after they have passed the heat transfer areas. The main task of the heat transfer areas is heat transfer. Since the adiabatic, distribution and heat transfer areas have different main tasks, the adiabatic, distribution and heat transfer patterns typically differ from each other.

Thus, in a gasketed plate heat exchanger ready for operation, the heat transfer plates are aligned with each other in a plate pack with gaskets arranged between each two adjacent ones of the heat transfer plates. Typically, the gaskets on the opposite sides of one and the same heat transfer plates are aligned with each other along most of their extension. However, to make it possible for two fluids to flow alternately through every second channel of the plate heat exchanger as described above, the gaskets on the opposite sides of one and the same heat transfer plate are not aligned with each other along parts of their extension. Along these parts, there is gasket support on only one side of the heat transfer plate.

For the plate heat exchanger to work properly, the heat transfer plates should contact each other within the above mentioned contact areas to make the plate pack strong, while the heat transfer plates should be separated from each other within other areas to allow the fluids to flow through the plate pack. However, depending on different factors such as the strength of the individual heat transfer plates, the tension between the heat transfer plates and the gaskets, and the fluid pressures inside the channels between the heat transfer plates, the heat transfer plates may suffer from deformation, especially close to areas where there is gasket support only on one side of the heat transfer plates. Such deformation may disturb the desired contact and separation between the plates. In turn, this may result in an impaired capacity or malfunctioning of the plate heat exchanger.

SUMMARY

An object of the present invention is to provide a heat transfer plate and a gasket which at least partly solve the above discussed problem of prior art. The basic concept of the invention is to locally vary a press depth of the heat transfer plate, and a thickness of a body of the gasket, to make the heat transfer plate less prone to deformation. The heat transfer plate, which is also referred to herein as just "plate", and the gasket for achieving the object above are defined in the appended claims and discussed below.

A heat transfer plate according to the invention comprises an upper end portion, a center portion and a lower end portion arranged in succession along a longitudinal center axis of the heat transfer plate. The upper end portion comprises a first and a second porthole and an upper distribution area provided with an upper distribution corrugation pattern. The lower end portion comprises a third and a fourth porthole and a lower distribution area provided with a lower distribution corrugation pattern. The center portion comprises a heat transfer area provided with a heat transfer corrugation pattern differing from the upper and lower distribution corrugation patterns. The heat transfer plate further comprises, on a front side thereof, a front gasket groove including an annular front groove part extending around the heat transfer area, the upper and lower distribution areas, and the first and third portholes, a second ring groove part enclosing the second porthole and a fourth ring groove part enclosing the fourth porthole. The upper end portion further comprises a second adiabatic area extending between the annular front groove part and the second ring groove part. The lower end portion further comprises a fourth adiabatic area extending between the annular front groove part and the fourth ring groove part. An upper front groove portion of the front gasket groove extends between the second porthole and the upper distribution area and comprises a bottom. A lower front groove portion of the front gasket groove extends between the fourth porthole and the lower distribution area and comprises a bottom. The heat transfer plate is characterized in that the bottom of the upper front groove portion is inclined or tilted such that a depth of the front gasket groove, within the upper front groove portion, increases in a direction towards the second adiabatic area, and the bottom of the lower front groove portion is inclined or tilted such that a depth of the front gasket groove, within the lower front groove portion, increases in a direction towards the fourth adiabatic area.

Here, the depth equals a distance between the bottom of a groove and a reference plane which is parallel to a central extension plane of the heat transfer plate, and the depth is measured perpendicular to the central extension plane.

Thus, the heat transfer plate is characterized in that a depth of the front gasket groove, within the upper and lower front groove portions, increases, from a first smallest depth to a first largest depth, along a transverse extension of the upper and lower front groove portions so as to be the first largest depth closest to the second and fourth adiabatic areas.

Imaginary upper and lower planes may define an extension of the heat transfer plate within the heat transfer area. A bottom of the front gasket groove, may, along more than half of its longitudinal extension, extend in the imaginary lower plane. Such an embodiment may facilitate permanent bonding of the heat transfer plate and an underlaying suitably designed heat transfer plate, possibly another heat transfer plate according to the present invention, into a cassette for use in a so-called semi-welded plate heat exchanger. Alternatively, the bottom of the front gasket groove, may, along more than half of its longitudinal extension, extend between, such as half way between, the imaginary upper and lower planes. Such an embodiment may enable use of the heat transfer plate in a plate heat exchanger with heat transfer plates rotated, as well as flipped, in relation to each other, and may be suitable for so-called asymmetric heat transfer plates.

The front gasket groove is arranged to accommodate a gasket for sealing, and definition of a front fluid channel, between the heat transfer plate and an overlaying suitably designed heat transfer plate, possibly another heat transfer plate according to the present invention. The front fluid channel may allow a fluid flow between the first and the third porthole of the heat transfer plate. The heat transfer plate is further arranged to cooperate with an underlaying suitably designed heat transfer plate, possibly yet another heat transfer plate according to the present invention, for definition of a back fluid channel. The back fluid channel may allow a fluid flow between the second and the fourth porthole of the heat transfer plate, i.e. a fluid flow through passages defined by a backside of the upper and lower front groove portions of the front gasket groove of the heat transfer plate. To achieve the above fluid flows, there should be no gasket on the backside, but only on the front side of the upper and lower front groove portions of the front gasket groove of the heat transfer plate. As above discussed, a heat transfer plate arranged in a plate heat exchanger may be prone to deformation close to areas with one-sided gasket support. By varying the depth of the upper and lower front groove portions of the front gasket groove of the heat transfer plate according to the present invention, undesired deformation of the heat transfer plate close to the upper and lower front groove portions of the front gasket groove may be minimized when the heat transfer plate is arranged in a plate heat exchanger together with gaskets and other heat transfer plates, which may ensure a proper performance of the plate heat exchanger.

In line with the above, the heat transfer plate may further comprise, on a back side thereof, a back gasket groove including an annular back groove part extending around the heat transfer area, the upper and lower distribution areas and the second and fourth portholes, a first ring groove part enclosing the first porthole and a third ring groove part enclosing the third porthole. Further, the upper end portion may comprise a first adiabatic area extending between the annular back groove part and the first ring groove part, and the lower end portion may comprise a third adiabatic area extending between the annular back groove part and the third ring groove part. An upper back groove portion of the back gasket groove may extend between the first porthole and the upper distribution area and comprise a bottom. A lower back groove portion of the back gasket groove may extend between the third porthole and the lower distribution area and comprise a bottom. The bottom of the upper back groove portion may be inclined or tilted such that a depth of the back gasket groove, within the upper back groove portion, increases in a direction towards the first adiabatic area. Further, the bottom of the lower back groove portion may be inclined or tilted such that a depth of the back gasket groove, within the lower back groove portion, increases in a direction towards the third adiabatic area.

Herein, "annular" does not necessarily means a circular extension, but could mean any enclosing extension, such as an oval or polygonal extension. Accordingly, the annular front and back groove parts of the front and back gasket grooves need not be circular but may have any form suitable for the heat transfer plate. Similarly, the second and fourth ring groove parts of the front gasket groove, and the first and third ring groove parts of the back gasket groove, need not be circular but may have any form suitable for the heat transfer plate, and especially the portholes thereof.

The first, second, third and fourth adiabatic areas may be provided with a first adiabatic corrugation pattern, a second adiabatic corrugation pattern, a third adiabatic corrugation pattern and a fourth adiabatic corrugation pattern, respectively, which first, second, third and fourth adiabatic corrugation patterns may differ from the upper and lower distribution corrugation patterns and the heat transfer corrugation pattern.

The depth of the front gasket groove, within the upper front groove portion and the lower front groove portion, and possibly the depth of the back gasket groove, within the upper back groove portion and the lower back groove portion, may be gradually increasing along the transverse extension of the upper and lower front groove portions of the front gasket groove, and along a transverse extension of the upper and lower back groove portions of the back gasket groove, respectively. For example, the gradual increase may be step-wise or wavelike. As another example, the depth may be linearly increasing in which case the bottom of the upper front groove portion and the bottom of the lower front groove portion, and possibly the bottom of the upper back groove portion and the bottom of the lower back groove portion, may be plane. This configuration may enable a relatively straight forward design of the heat transfer plate.

The heat transfer plate may be so designed that the upper front groove portion of the front gasket groove is comprised in an upper diagonal portion of the annular front groove part of the front gasket groove, which upper diagonal portion extends between the second adiabatic area and the upper distribution area. Further, said lower front groove portion of the front gasket groove may be comprised in a lower diagonal portion of the annular front groove part of the front gasket groove, which lower diagonal portion extends between the fourth adiabatic area and the lower distribution area. Thereby, the depth of the upper and lower front groove portions of the front gasket groove will increase in a direction towards the second and fourth portholes. Such an embodiment may strengthen the heat transfer plate close to the upper and lower diagonal portions. Consequently, deformation, by fluid pressure, of the heat transfer plate close to the upper and lower diagonal portions may be prevented when the heat transfer plate is arranged in a plate heat exchanger. In turn, this may ensure that the desired contact between the heat transfer plate and adjacent heat transfer plates in the plate heat exchanger is achieved.

Alternatively/additionally, the heat transfer plate may be so designed that the upper front groove portion of the front gasket groove is comprised in an inner portion of the second ring groove part of the front gasket groove, which inner portion extends between the second porthole and the second adiabatic area. Further, the lower front groove portion of the front gasket groove may be comprised in an inner portion of the fourth ring groove part of the front gasket groove, which inner portion extends between the fourth porthole and the fourth adiabatic area. Thereby, the depth of the upper and lower front groove portions of the front gasket groove will increase in a direction away from the second and fourth portholes. The inner portion of the second ring groove part may be 25-65% of the second ring groove part. Similarly, the inner portion of the fourth ring groove part may be 25-65% of the fourth ring groove part. This embodiment may strengthen the heat transfer plate close to the upper and lower diagonal portions. Consequently, deformation, by fluid pressure, of the heat transfer plate close to the inner portions of the second and fourth ring groove parts may be prevented when the heat transfer plate is arranged in a plate heat exchanger. In turn, this may ensure that the desired contact between the heat transfer plate and adjacent heat transfer plates in the plate heat exchanger is achieved The portholes of the heat transfer plate are defined by inner plate edges which may, or may not, be corrugated. The heat transfer plate may be so designed that a bottom of the second ring groove part comprises an annular second inner edge defining the second porthole, while a bottom of the fourth ring groove comprises an annular fourth inner edge defining the fourth porthole. According to this embodiment, the second and fourth ring groove parts extend all the way to the second and fourth portholes, respectively. If the bottoms of the second and fourth ring groove parts are plane, this embodiment means that the second and fourth portholes of the heat transfer plate are defined by plane, i.e. not corrugated, inner plate edges. By omitting the corrugation around the second and fourth portholes, the hygiene of the heat transfer plate may be improved, and the plate surface available for heat transfer may be increased. By varying, in accordance with the present invention, the depth of the front gasket groove within the inner portions of the second and fourth ring groove parts on a heat transfer plate without corrugations around the portholes, the heat transfer plate may be "pre-deformed" in one direction. When the heat transfer plate is arranged in a plate heat exchanger, an overlying heat transfer plate and an intermediate gasket accommodated in the second and fourth ring groove parts of the heat transfer plate will deform the heat transfer plate in the opposite direction. This will result in a reset of the "pre-deformation" and inner plate edges extending, at least along part of their extension, essentially parallel to the central extension plane of the heat transfer plate, i.e. the desired separation between the heat transfer plate and the adjacent heat transfer plates in the plate heat exchanger. In turn, this will decrease a pressure drop for a fluid entering a channel defined by the back side of the heat transfer plate.

The heat transfer plate may be so designed that the first and third portholes are arranged on one side of the longitudinal center axis of the heat transfer plate, and the second and fourth portholes are arranged on another opposite side of the longitudinal center axis. Thereby, the heat transfer plate may be suitable for use in a plate heat exchanger of so-called parallel flow type. Such a parallel-flow heat exchanger may comprise only one plate type. If instead the first and fourth portholes are arranged on one and the same side, and the second and third porthole are arranged on the same and the other side, of the longitudinal center axis, which is also possible according to the invention, the plate may be suitable for use in a plate heat exchanger of so-called diagonal flow type. Such a diagonal flow heat exchanger may typically comprise more than one plate type.

The heat transfer plate may be so designed that the upper front groove portion of the front gasket groove is a mirroring, parallel to a transverse center axis of the heat transfer plate, of the lower front groove portion of the front gasket groove. This may enable a plate pack containing only heat transfer plates according to the present invention.

Naturally, different designs of the back gasket groove corresponding to the above discussed different designs of the front gasket groove are conceivable.

A gasket for a plate heat exchanger according to the invention comprises an annular gasket part, an annular second ring gasket part and an annular fourth ring gasket part. The second and fourth ring gasket parts are arranged outside, and on opposite sides of, the annular gasket part. The second ring gasket part and the annular gasket part are separated by a second intermediate space and the fourth ring gasket part and the annular gasket part are separated by a fourth intermediate space. An upper gasket portion of the gasket limits, defines or extends along the second intermediate space. A lower gasket portion of the gasket limits, defines or extends along the fourth intermediate space. The gasket comprises a body extending along the complete annular gasket part and second and fourth ring gasket parts and comprising an upper side and an opposing lower side. The upper and lower sides of the gasket body define a thickness of the body. The gasket is characterized in that the thickness of the body of the gasket, within the upper gasket portion, increases in a direction towards the second intermediate space and, within the lower gasket portion, increases in a direction towards the fourth intermediate space.

The thickness of the body of the gasket may, within the upper gasket portion and the lower gasket portion, be gradually, possibly linearly, increasing along a transverse extension of the upper and lower gasket portions of the gasket.

The upper and lower sides of the gasket body may be essentially plane.

The upper gasket portion of the gasket may be comprised in an upper diagonal portion of the annular gasket part of the gasket, which upper diagonal portion extends on an inside of the second ring gasket part of the gasket. The lower gasket portion of the gasket may be comprised in a lower diagonal portion of the annular gasket part of the gasket, which lower diagonal portion extends on an inside of the fourth ring gasket part of the gasket.

Alternatively/additionally, the upper gasket portion of the gasket may be comprised in an inner portion of the second ring gasket part of the gasket, which inner portion extends between an outer portion of the second ring gasket part of the gasket and an upper diagonal portion of the annular gasket part of the gasket, which upper diagonal portion extends on an inside of the second ring gasket part of the gasket. Further, the lower gasket portion of the gasket may be comprised in an inner portion of the fourth ring gasket part of the gasket, which inner portion extends between an outer portion of the fourth ring gasket part of the gasket and a lower diagonal portion of the annular gasket part of the gasket, which lower diagonal portion extends on an inside of the fourth ring gasket part of the gasket.

The gasket may further comprise at least one elongate projection projecting from one of the upper side and the lower side of the body and extending along at least the upper and lower gasket portions of the gasket. Such a projection may improve the sealing capability of the gasket.

The at least one elongate projection may be arranged offset from a second center plane of the body. Thereby, the sealing features of the gasket may be optimized.

The gasket may be so configured that the second center plane of the body of the gasket is arranged between the at least one projection and the second intermediate space within the upper gasket portion, and between the at least one projection and the fourth intermediate space within the lower gasket portion. Such an arrangement may position the projection relatively close to a fluid when the gasket is arranged between two heat transfer plates in a plate heat exchanger, which in turn may enable early prevention of fluid leakage.

The gasket may have such a design that the second and fourth ring gasket parts of the gasket are arranged on one and the same side of a longitudinal center axis of the gasket.

The upper gasket portion of the gasket may be a mirroring, parallel to a transverse center axis of the gasket, of the lower gasket portion of the gasket.

The heat transfer plate and the gasket according to the invention are adapted to be used together, and the design of the gasket is adapted to the design of the heat transfer plate, and vice versa. Thus, the above different embodiments of the gasket according to the invention correspond to the above different embodiments of the heat transfer plate according to the invention. Accordingly, the advantages of the above different embodiments of the heat transfer plate are transferable to the above different embodiments of the gasket. Naturally, these advantages appear first when the heat transfer plate and the gasket cooperate with each other and other suitably designed heat transfer plates and gaskets in a plate heat exchanger.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

FIGS. 1-7 show a heat transfer plate 1, hereinafter also referred to as just "plate", for a gasketed plate heat exchanger as described by way of introduction. In the gasketed plate heat exchanger, a plurality of heat transfer plates like the heat transfer plate 1, i.e. a plurality of similar heat transfer plates, are aligned in a plate pack.

Figure 1:
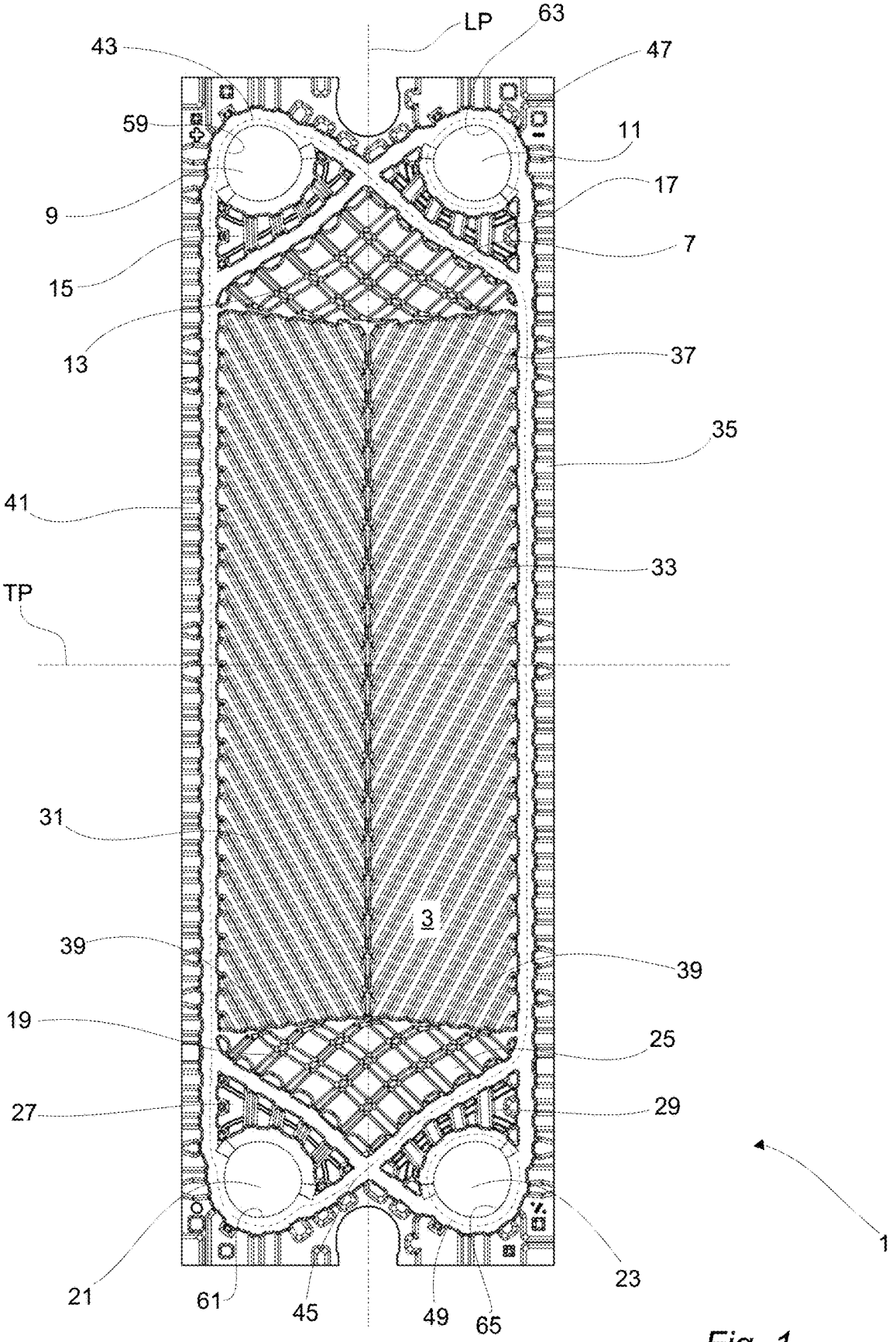
FIG. 1 is a schematic plan view of a heat transfer plate according to the invention, illustrating a front side thereof.

With reference to FIG. 1, the plate 1 is an essentially rectangular sheet of stainless steel having a front side 3 (illustrated in FIGS. 1, 2 and 5) and an opposing back side 5 (illustrated in FIGS. 3, 4, 6 and 7). The plate 1 comprises an upper end portion 7, which in turn comprises a first porthole 9, a second porthole 11, an upper distribution area 13, a first adiabatic area 15 and a second adiabatic area 17, and a lower end portion 19, which in turn comprises a third porthole 21, a fourth porthole 23, a lower distribution area 25, a third adiabatic area 27 and a fourth adiabatic area 29. The plate 1 further comprises a center portion 31, which in turn comprises a heat transfer area 33, and an outer edge portion 35 extending around the upper and lower end portions 7 and 19 and the center portion 31. The upper end portion 7 adjoins the center portion 31 along an upper borderline 37, while the lower end portion 19 adjoins the center portion 31 along a lower borderline 39. The upper end portion 7, the center portion 31 and the lower end portion 19 are arranged in succession along a longitudinal center axis LP of the plate 1, which extends perpendicular to a transverse center axis TP of the plate 1. The first and third portholes 9 and 21 are arranged on one and the same side of the longitudinal center axis LP, while the second and fourth portholes 11 and 23 are arranged on one and the other side of the longitudinal center axis LP. The upper end portion 7 is a mirroring, parallell to the transverse center axis TP of the of the heat transfer plate 1, of the lower end portion 19.

The heat transfer plate 1 is pressed, in a conventional manner, in a pressing tool, to be given a desired structure, such as different corrugation patterns within different portions of the heat transfer plate. As was discussed by way of introduction, the corrugation patterns are optimized for the specific functions of the respective plate portions. Accordingly, the upper and lower distribution areas 13 and 25 are provided with a distribution pattern of chocolate type while the heat transfer area 33 is provided with a heat transfer pattern of herringbone type. The first, second, third and fourth adiabatic areas 15, 17, 27 and 29 comprise corrugations adapted to transfer a fluid with minimized heat transfer. Further, the outer edge portion 35 comprises corrugations 41 which make the outer edge portion 35 stiffer and, thus, the heat transfer plate 1 more resistant to deformation. Further, the corrugations 41 form a support structure in that they are arranged to abut corrugations within outer edge portions of adjacent heat transfer plates in a plate pack of a heat exchanger. The corrugations 41 extend between and in imaginary lower and upper planes P1 and P2 (FIGS. 3, 4, 6 and 7), which are parallel to the figure plane of FIGS. 1 and 2.

With reference to FIG. 1, pressed into the front side 3 of the heat transfer plate 1 is also a front gasket groove 43, the extension of which is partly illustrated, with broken lines, in FIG. 1. The front gasket groove 43 comprises an annular front groove part 45, an second ring groove part 47 and a fourth ring groove part 49. The annular front groove part 45 encloses the heat transfer area 33, the upper and lower distribution areas 13 and 25, the first and third adiabatic areas 15 and 27, and the first and third portholes 9 and 21. The second ring groove part 47 encloses the second porthole 11, while the fourth ring groove part 49 encloses the fourth porthole 23. An upper half of the front gasket groove 43 is a mirroring, parallel to the transverse center axis TP of the of the heat transfer plate 1, of a lower half of the front gasket groove 43. Further, with reference to FIGS. 2 to 7, the plate 1 further comprises, on the back side 5 thereof, a back gasket groove 51, the extension of which is partly illustrated, with broken lines, in FIGS. 2 and 5. The back gasket groove 51 comprises an annular back groove part 53, a first ring groove part 55 and a third ring groove part 57. The annular back groove part 53 encloses the heat transfer area 33, the upper and lower distribution areas 13 and 25, the second and fourth adiabatic areas 17 and 29, and the second and fourth portholes 11 and 23. The first ring groove part 55 encloses the first porthole 9, while the third ring groove part 57 encloses the third porthole 21. An upper half of the back gasket groove 51 is a mirroring, parallel to the transverse center axis TP of the heat transfer plate 1, of a lower half of the back gasket groove 51. Along the heat transfer area 33, the front gasket groove 43, or more particularly the annular front groove part 45 thereof, is aligned within the back gasket groove 51, or more particularly the annular back groove part 53 thereof.

Figure 2:
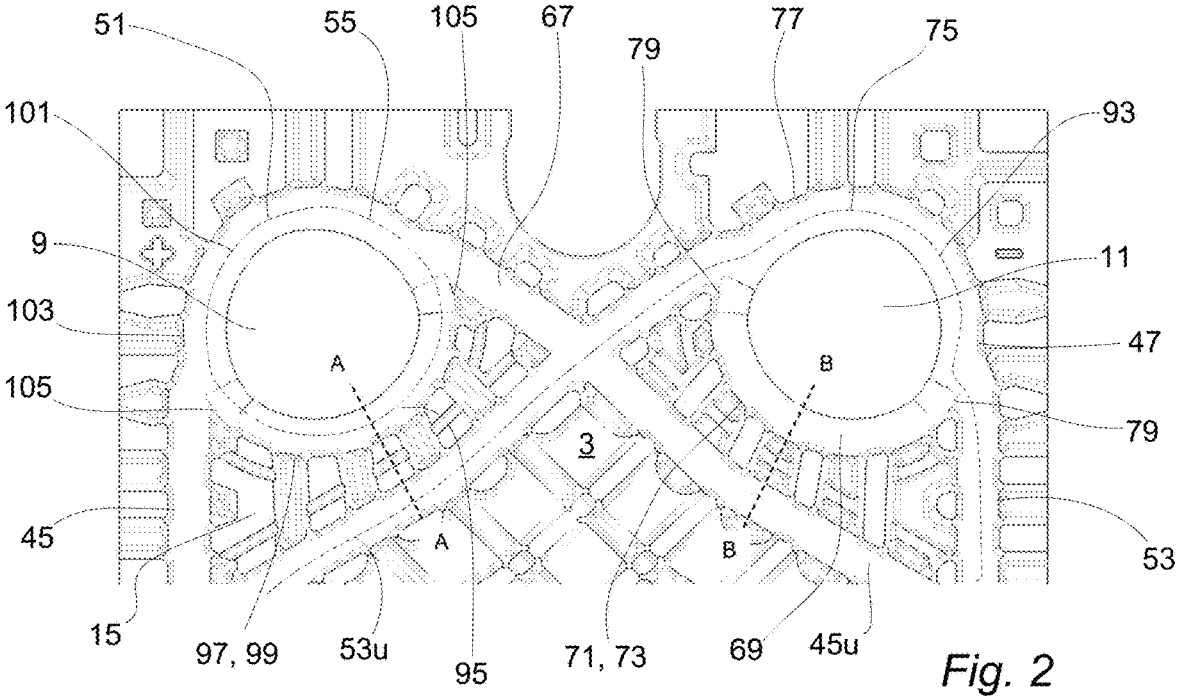
FIG. 2 is an enlargement of a part of the view in FIG. 1.
Figure 5:
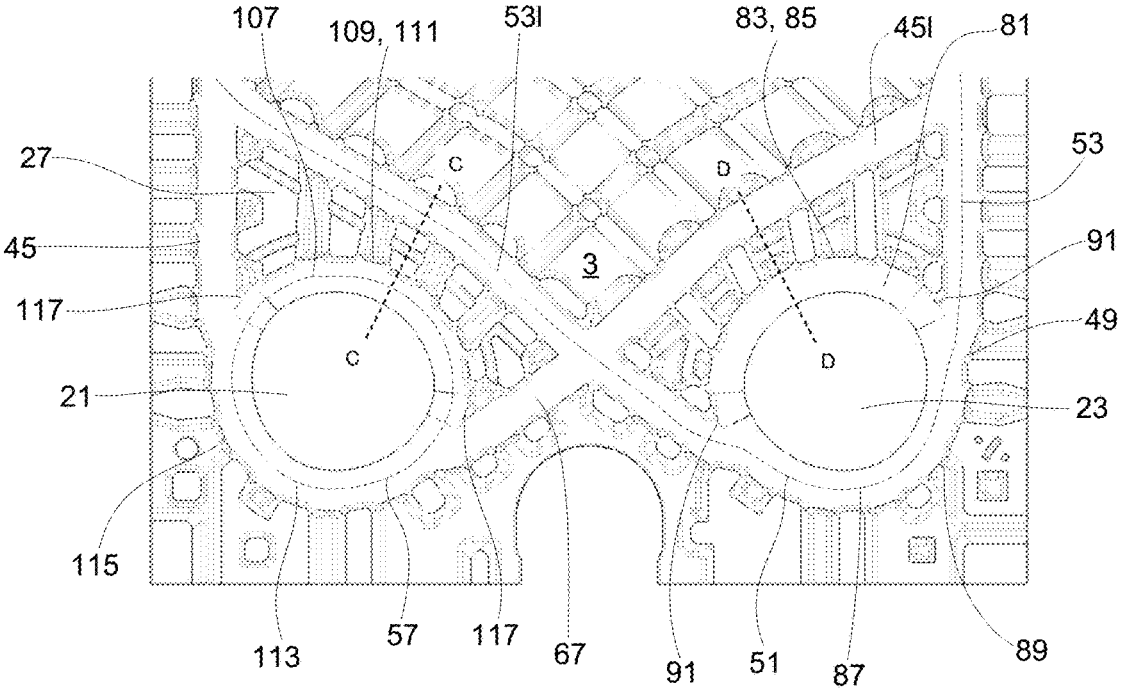
FIG. 5 is an enlargement of another part of the view in FIG. 1.

With reference to FIGS. 1, 2 and 5, the first ring groove part 55 and the third ring groove part 57 of the back gasket groove 51 comprise an annular first inner edge 59 defining the first porthole 9, and an annular third inner edge 61 defining the third porthole 21, respectively, of the plate 1. Similarly, the second ring groove part 47 and the fourth ring groove part 49 of the front gasket groove 43 comprise an annular second inner edge 63 defining the second porthole 11, and an annular fourth inner edge 65 defining the fourth porthole 23, respectively, of the plate 1.

Figure 4:
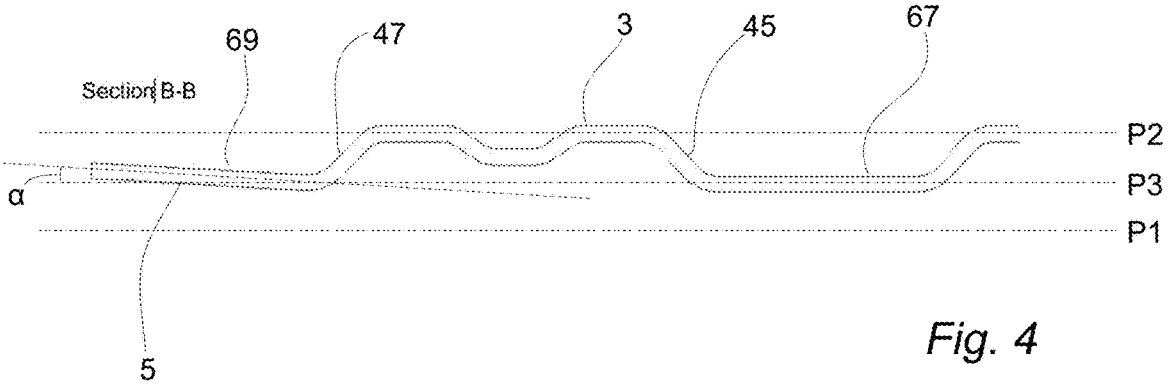
FIG. 4 illustrates another cross section of the heat transfer plate in FIG. 1, taken along line B-B in FIG. 2.
Figure 7:
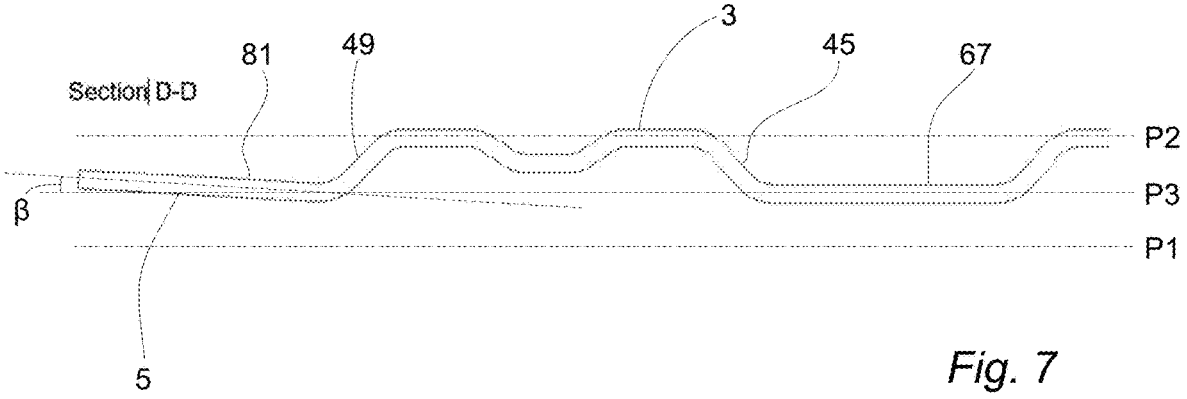
FIG. 7 illustrates yet another cross section of the heat transfer plate in FIG. 1, taken along line D-D in FIG. 5.

With reference to FIGS. 2 and 5, which illustrate a front side of the front gasket groove 43, and FIGS. 4 and 7 which illustrate local cross sections of the front gasket groove 43, a bottom 67 of the annular front groove part 45 is plane and extends in an imaginary plane P3 arranged between the imaginary lower and upper planes P1 and P2. Thereby, along essentially the complete extension of the annular front groove part 45, the depth of the front gasket groove 43 is essentially constant along a transverse extension of the front gasket groove 43, even if the depth may vary within different longitudinal sections of the annular front groove part 45. As an example, the depth of the front gasket groove 43 along two opposite long sides of the heat transfer plate 1 may differ from the depth of the front gasket groove 43 along upper and lower diagonal portions 45*u* and 45*l* of the annular front groove part 45 extending on an inside of the second and fourth ring groove parts 47 and 49. Further, a bottom 69 of an upper front groove portion 71 of the front gasket groove 43, here an inner portion 73 of the second ring groove part 47, is plane and inclined an angle $\alpha$, which here equals 3 degrees, in relation to the plane P3. This angle may have other values in alternative embodiments of the invention. Thereby, a depth of the second ring groove part 47, within the inner portion 73 thereof, is linearly gradually increasing in a direction away from the second porthole 11. A bottom 75 of an outer portion 77 of the second ring groove part 47, which outer portion 77 is arranged between two transition portions 79 of the second ring groove part 47, is plane and extends in the plane P3. Thereby, along the outer portion 77 of the second ring groove part 47, the depth of the front gasket groove 43 is essentially constant along a transverse extension of the front gasket groove 43. Similarly, a bottom 81 of an lower front groove portion 83 of the front gasket groove 43, here an inner portion 85 of the fourth ring groove part 49, is plane and inclined an angle $\beta$, which here equals 3 degrees, in relation to the plane P3. This angle may have other values in alternative embodiments of the invention. Thereby, a depth of the fourth ring groove part 49, within the inner portion 85 thereof, is linearly gradually increasing in a direction away from the fourth porthole 23. A bottom 87 of an outer portion 89 of the fourth ring groove part 49, which outer portion 89 is arranged between two transition portions 91 of the fourth ring groove part 49, is plane and extends in the plane P3. Thereby, along the outer portion 89 of the fourth ring groove part 49, the depth of the front gasket groove 43 is essentially constant along a transverse extension of the front gasket groove 43. Here, the depth is equal to the distance between the groove bottom and the plane P2, measured perpendicular to the plane P2.

Figure 3:
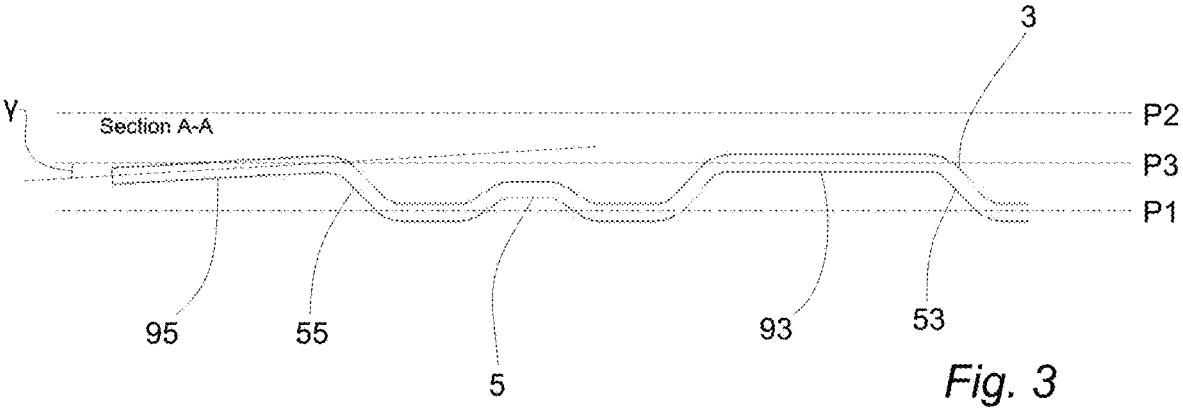
FIG. 3 illustrates a cross section of the heat transfer plate in FIG. 1, taken along line A-A in FIG. 2.
Figure 6:
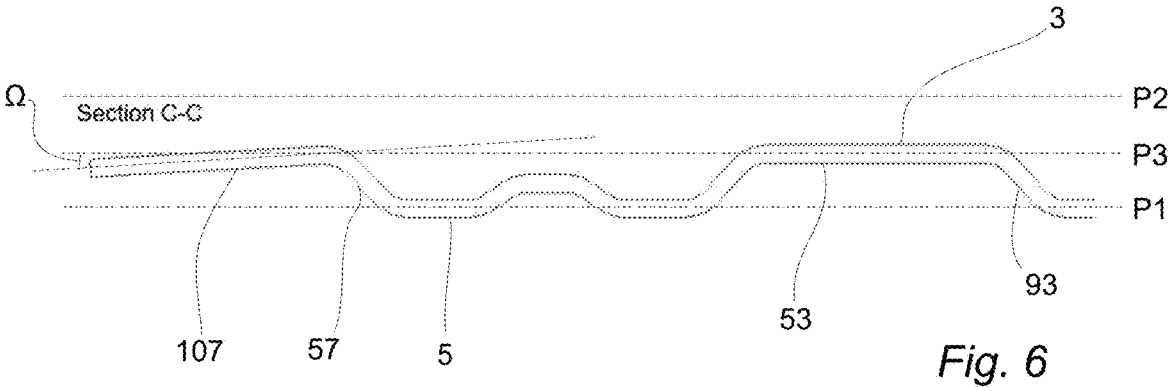
FIG. 6 illustrates another cross section of the heat transfer plate in FIG. 1, taken along line C-C in FIG. 5.

With reference to FIGS. 2 and 5, which illustrate a back side of the back gasket groove 51, and FIGS. 3 and 6 which illustrate local cross sections of the back gasket groove 51, a bottom 93 of the annular back groove part 53 is plane and extends in the plane P3. Thereby, along essentially the complete extension of the annular back groove part 53, the depth of the back gasket groove 51 is essentially constant along a transverse extension of the back gasket groove 51, even if the depth may vary within different longitudinal sections of the annular back groove part 53. As an example, the depth of the back gasket groove 51 along two opposite long sides of the heat transfer plate 1 may differ from the depth of the back gasket groove 51 along upper and lower diagonal portions 53*u* and 53*l* of the annular back groove part 53 extending on an inside of the first and third ring groove parts 55 and 57. Further, a bottom 95 of an upper back groove portion 97 of the back gasket groove 51, here an inner portion 99 of the first ring groove part 55, is plane and inclined an angle γ, which here equals 3 degrees, in relation to the plane P3. This angle may have other values in alternative embodiments of the invention. Thereby, a depth of the first ring groove part 55, within the inner portion 99 thereof, is linearly gradually increasing in a direction away from the first porthole 9. A bottom 101 of an outer portion 103 of the first ring groove part 55, which outer portion 103 is arranged between two transition portions 105 of the first ring groove part 55, is plane and extends in the plane P3. Thereby, along the outer portion 103 of the first ring groove part 55, the depth of the back gasket groove 51 is essentially constant along a transverse extension of the back gasket groove 51. Similarly, a bottom 107 of a lower back groove portion 109 of the back gasket groove 51, here an inner portion 111 of the third ring groove part 57, is plane and inclined an angle Ω, which here equals 3 degrees, in relation to the plane P3. This angle may have other values in alternative embodiments of the invention. Thereby, a depth of the third ring groove part 57, within the inner portion 111 thereof, is linearly gradually increasing in a direction away from the third porthole 21. A bottom 113 of an outer portion 115 of the third ring groove part 57, which outer portion 115 is arranged between two transition portions 117 of the third ring groove part 57, is plane and extends in the plane P3. Thereby, along the outer portion 115 of the third ring groove part 57, the depth of the back gasket groove 51 is essentially constant along a transverse extension of the back gasket groove 51. Here, the depth is equal to the distance between the groove bottom and the plane P1, measured perpendicular to the plane P1.

Figure 8:
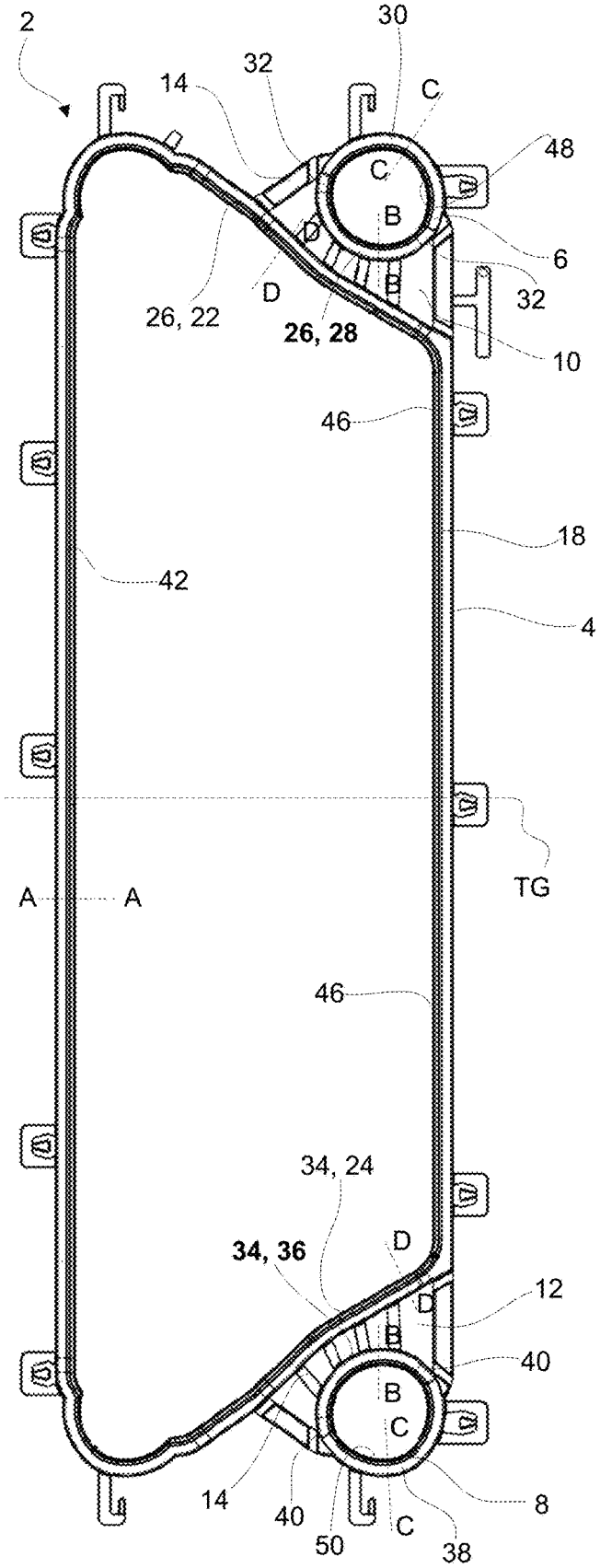
FIG. 8 is a schematic plan view of a gasket according to the invention, illustrating an upper side thereof.
Figure 9:
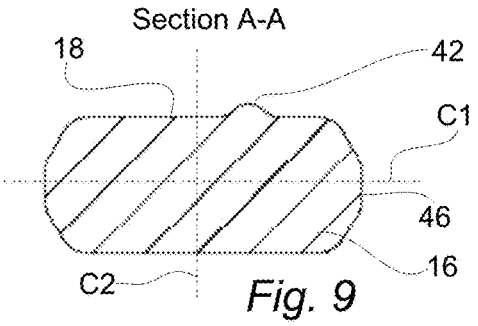
FIG. 9 illustrates a cross section of the gasket in FIG. 8, taken along line A-A in FIG. 8.
Figure 10:
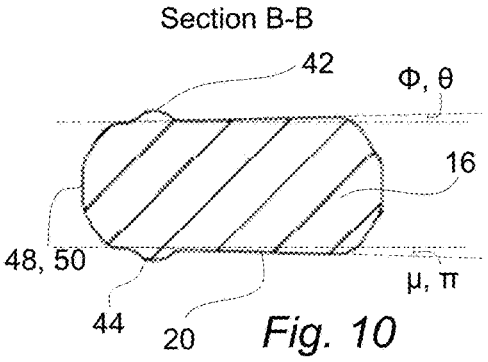
FIG. 10 illustrates a cross section of the gasket in FIG. 8, taken along line B-B in FIG. 8.
Figure 11:
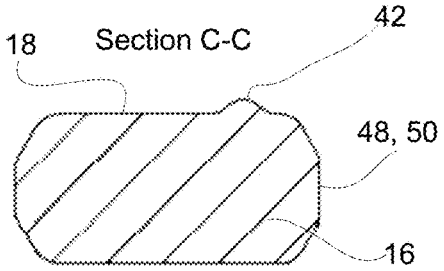
FIG. 11 illustrates a cross section of the gasket in FIG. 8, taken along line C-C in FIG. 8.
Figure 12:
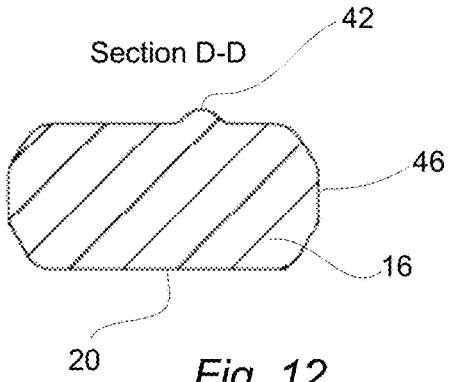
FIG. 12 illustrates a cross section of the gasket in FIG. 8, taken along line D-D in FIG. 8.
Figure 13:
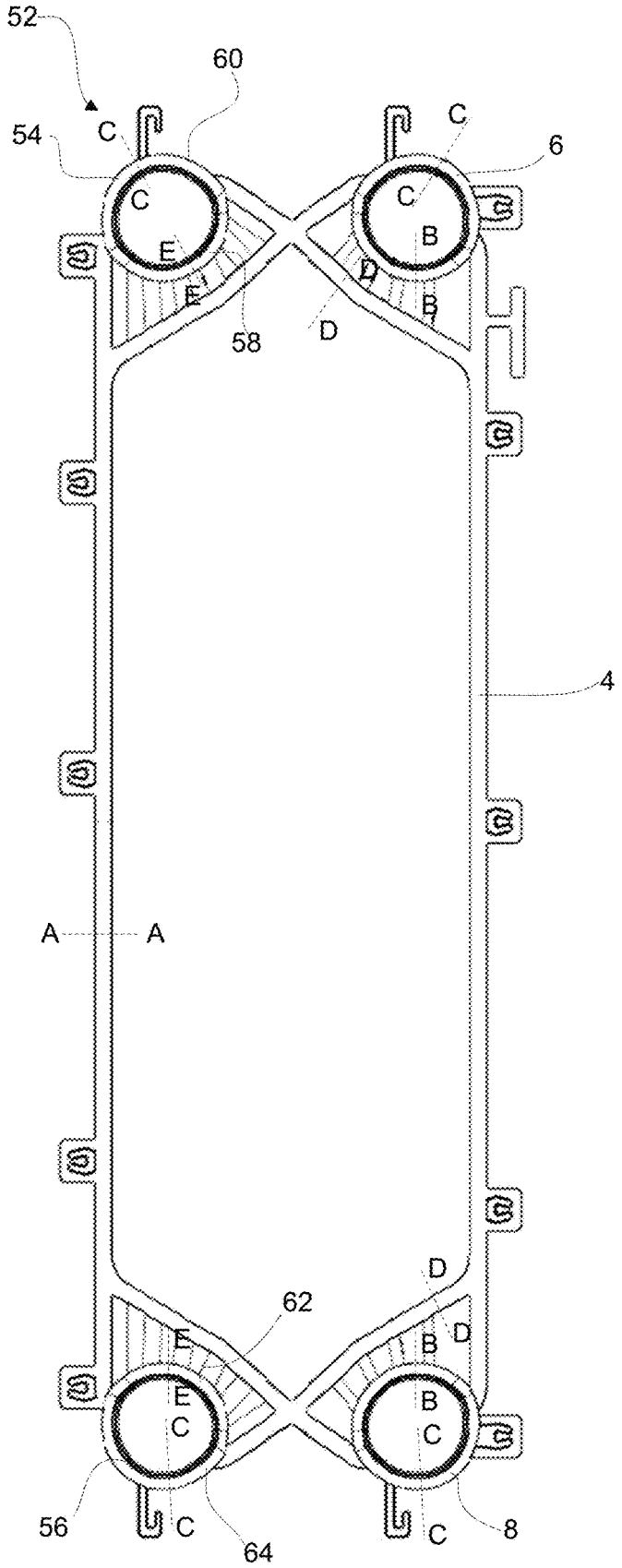
FIG. 13 is a schematic plan view of another gasket according to the invention, illustrating an upper side thereof.
Figure 14:
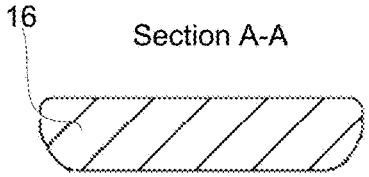
FIG. 14 illustrates a cross section of the gasket in FIG. 13, taken along line A-A in FIG. 8.
Figure 15:
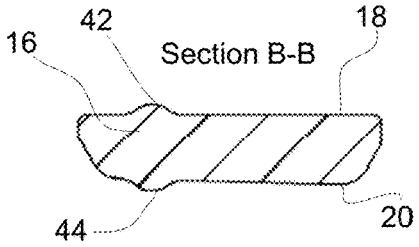
FIG. 15 illustrates a cross section of the gasket in FIG. 13, taken along line B-B in FIG. 8.
Figure 16:
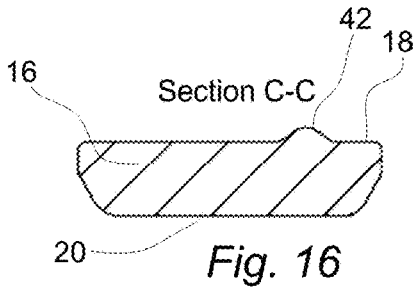
FIG. 16 illustrates a cross section of the gasket in FIG. 13, taken along line C-C in FIG. 8.
Figure 17:
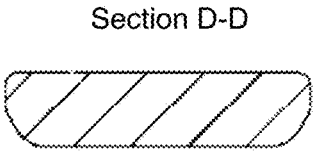
FIG. 17 illustrates a cross section of the gasket in FIG. 13, taken along line D-D in FIG. 8.
Figure 18:
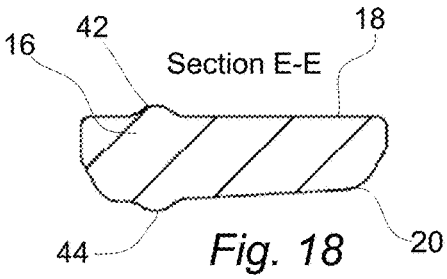
FIG. 18 illustrates a cross section of the gasket in FIG. 13, taken along line E-E in FIG. 8.

As said above, in a gasketed plate heat exchanger, a plurality of heat transfer plates like the heat transfer plate 1 are aligned in a plate pack, here "rotated" in relation to each other. Between each two adjacent ones of the heat transfer plates, a rubber gasket 2 as illustrated in FIGS. 8-12 is arranged. The gasket 2 as orientated in FIG. 8 is arranged on the heat transfer plate 1 as orientated in FIG. 1. More particularly, the gasket 2 is accommodated in the front gasket groove 43 of the plate 1 such that an annular gasket part 4 of the gasket 2 is received in the annular front groove part 45, while an annular second ring gasket part 6 and an annular fourth ring gasket part 8 of the gasket 2 are received in the second ring groove part 47 and the fourth ring groove part 49, respectively. With reference to FIG. 8, the annular gasket part 4 and the second ring gasket part 6 are separated by a second intermediate space 10, while the annular gasket part 4 and the fourth ring gasket part 8 are separated by a fourth intermediate space 12. However, as illustrated in FIG. 8, the second and fourth ring gasket parts 6 and 8 are connected to the annular gasket part 4 by means of a plurality of joints 14 bridging the second and fourth intermediate spaces 10 and 12. The joints 14 could be omitted in alternative embodiment of the invention. An upper half of the annular gasket part 4 and the second ring gasket part 6 are mirrorings, parallel to a transverse center axis TG of the gasket 2, of a lower half of the annular gasket part 4 and the fourth ring gasket part 8.

With reference to FIGS. 9-12 illustrating local transverse cross sections of the gasket 2, the gasket 2 comprises an elongate body 16 extending along the annular gasket part 4, the second ring gasket part 6 and the fourth ring gasket part 8. The body 16 comprises an essentially plane upper side 18 and an opposing essentially plane lower side 20, the lower side 20 being arranged to face the front side 3 of the plate 1. The thickness of the gasket body 16 equals the distance between the upper and lower sides 18, 20 of the body 16.

The design of the gasket 2 is adapted to the design of the plate 1, and vice versa. Accordingly, the upper and lower sides 18 and 20 of the gasket body 16 extend parallel to each other, and to a first center plane C1 of the gasket body 16, along essentially the complete extension of the annular gasket part 4. Thereby, along essentially the complete extension of the annular gasket part 4, the thickness of the gasket body 16 is essentially constant along a transverse extension of the gasket body 16, even if the thickness may vary within different longitudinal sections of the annular gasket part 4. As an example, the thickness of the gasket body 16 along the portions of annular gasket part 4 arranged to extend along the two opposite long sides of the heat transfer plate 1 may differ from the thickness of the gasket body 16 along upper and lower diagonal portions 22 and 24 of the annular gasket part 4 extending on an inside of the second and fourth ring gasket parts 6 and 8. Further, along an upper gasket portion 26 defining the second intermediate space 10, here an inner portion 28 of the second ring gasket part 6 (bold reference numerals in FIG. 8), the upper side 18 of the gasket body 16 is inclined an angle θ, which here equals 2 degrees, in relation to the first center plane C1, while the lower side 20 of the gasket body 16 is inclined an angle μ, which here equals 2 degrees, in relation to the first center plane C1. Thereby, the thickness of the gasket body 16, within the inner portion 28 of the second ring gasket part 6, is, is linearly gradually increasing in a direction towards the upper diagonal portion 22. Along an outer portion 30 of the second ring gasket part 6, which outer portion 30 is arranged between two transition portions 32 of the second ring gasket part 6, the upper and lower sides 18 and 20 of the gasket body 16 extend parallel to each other, so as to give the gasket body 16 an essentially constant thickness along a transverse extension of the gasket body 16. Further, along a lower gasket portion 34 defining the fourth intermediate space 12, here an inner portion 36 of the fourth ring gasket part 8 (bold reference numerals in FIG. 8), the upper side 18 of the gasket body 16 is inclined an angle ϕ, which here equals 2 degrees, in relation to the first center plane C1, while the lower side 20 of the gasket body 16 is inclined an angle π, which here equals 2 degrees, in relation to the first center plane C1. Thereby, the thickness of the gasket body 16, within the inner portion 36 of the fourth ring gasket part 8, is, is linearly gradually increasing in a direction towards the lower diagonal portion 24. Along an outer portion 38 of the fourth ring gasket part 8, which outer portion 38 is arranged between two transition portions 40 of the fourth ring gasket part 8, the upper and lower sides 18 and 20 of the gasket body 16 extend parallel to each other, so as to give the gasket body 16 an essentially constant thickness along a transverse extension of the gasket body 16.

Besides for the body 16, the gasket 2 further comprises an elongate upper projection 42 projecting from the upper side 18 of the body 16 and an elongate lower projection 44 projecting from the lower side 20 of the body 16. The upper projection 42 extends along the annular gasket part 4, the second ring gasket part 6 and the fourth ring gasket part 8, while the lower projection 44 extends along the inner portions 28 and 36 of the second and fourth ring gasket parts 6, 8 only. The opposing upper and lower projections 42 and 44 are arranged offset from a second center plane C2, which is orthogonal to the first center plane C1. Within the annular gasket part 4 of the gasket 2, the upper projection 42 is displaced towards an inner periphery 46 of the annular gasket part 4, within the second ring gasket part 6 of the gasket 2 the upper and lower projections 42 and 44 are displaced towards an inner periphery 48 of the second ring gasket part 6, and within the fourth ring gasket part 8 of the gasket 2 the upper and lower projections 42 and 44 are displaced towards an inner periphery 50 of the fourth ring gasket part 8.

Figure 19:
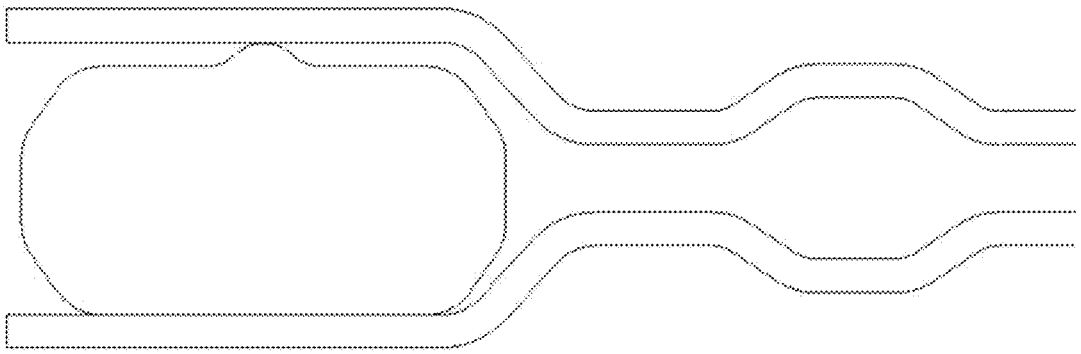
FIG. 19 illustrates two adjacent heat transfer plates of plate pack and an intermediate gasket according to prior art, prior to compression of the plate pack.
Figure 20:
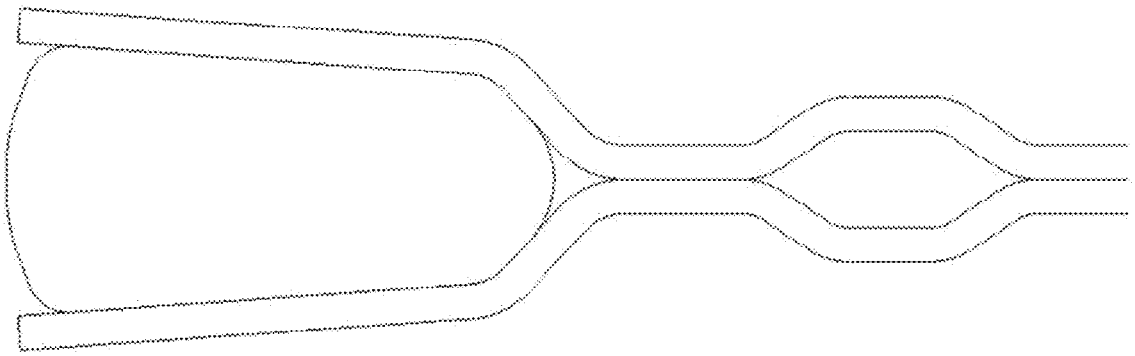
FIG. 20 illustrates the heat transfer plates and the gasket in FIG. 19 after compression of the plate pack.
Figure 21:
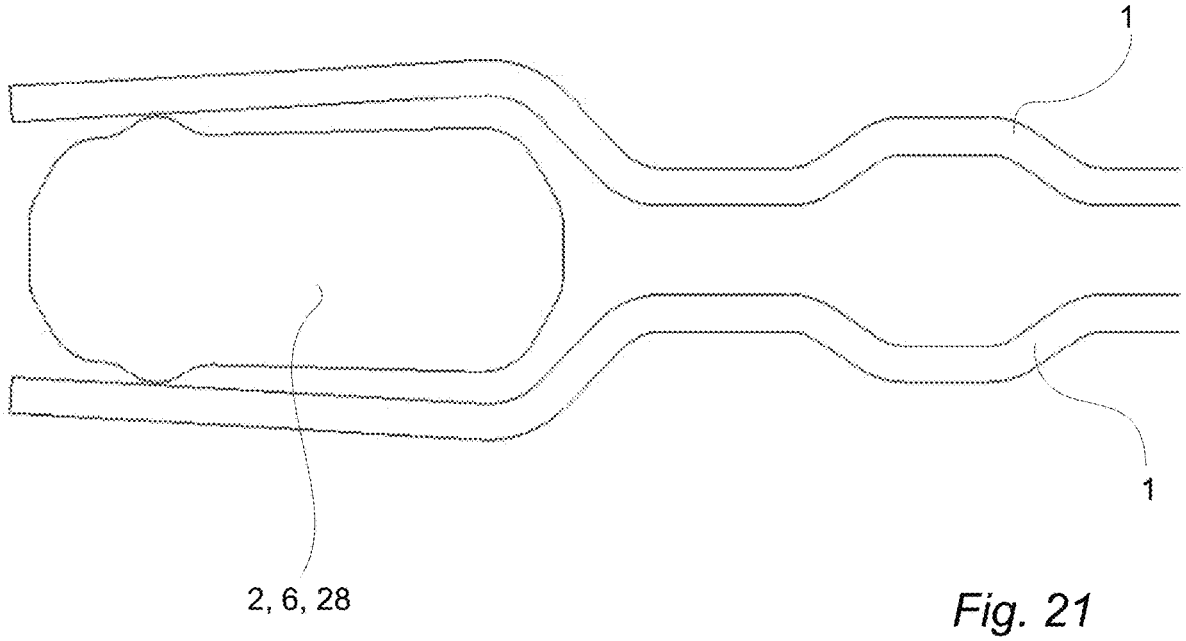
FIG. 21 illustrates two adjacent heat transfer plates of plate pack and an intermediate gasket according to the invention, prior to compression of the plate pack.
Figure 22:
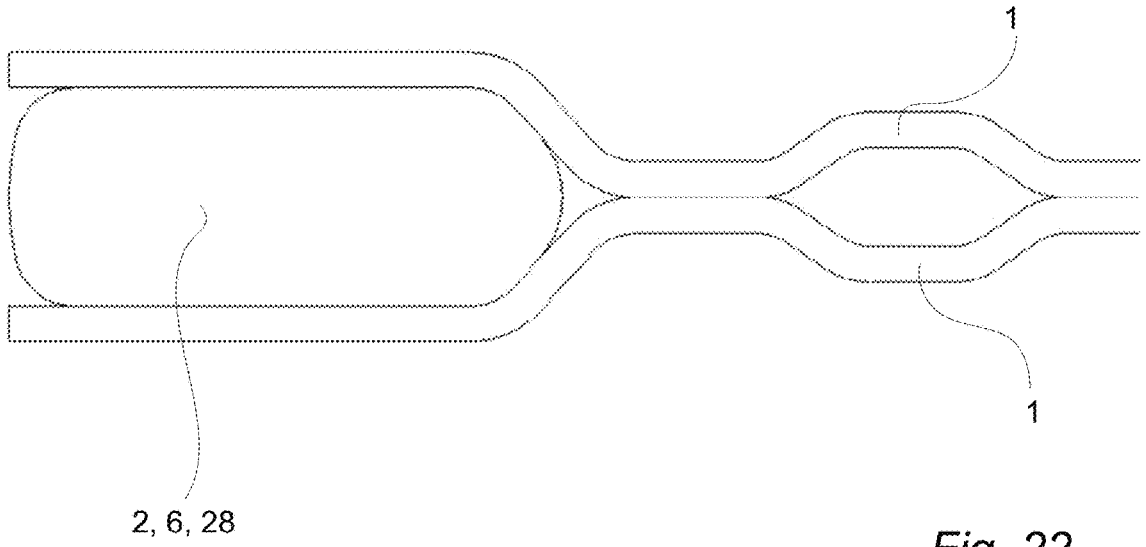
FIG. 22 illustrates the heat transfer plates and the gasket in FIG. 21 after compression of the plate pack, FIG. 23 corresponds to FIG. 2 for a plate according to an alternative embodiment of the invention, FIG. 24 corresponds to FIG. 3 for a plate according to an alternative embodiment of the invention, FIG. 25 corresponds to FIG. 4 for a plate according to an alternative embodiment of the invention, FIG. 26 corresponds to FIG. 5 for a plate according to an alternative embodiment of the invention, FIG. 27 corresponds to FIG. 6 for a plate according to an alternative embodiment of the invention, FIG. 28 corresponds to FIG. 7 for a plate according to an alternative embodiment of the invention.

FIGS. 21 and 22 illustrate what it looks like, in cross section at the inner portion 28 of the second ring gasket part 6 of a gasket 2 according to the invention, when the gasket 2 is arranged between two heat transfer plates 1 according to the invention, with one of the heat transfer plates being rotated in relation to the other heat transfer plate. Then, with reference to FIGS. 1, 2, 5 and 8, the inner portion 28 of the second ring gasket part 6 of the gasket 2 is arranged between the inner portion 73 of the second ring groove part 47 of the front gasket groove 43 of the lower heat transfer plate 1, and the inner portion 111 of the third ring groove part 57 of the back gasket groove 51 of the upper heat transfer plate 1. FIG. 21 illustrates what it looks like when the plates 1 are not pressed against each other, the varying gasket groove depths of the plates and the varying thickness of the gasket body. FIG. 22 illustrates what it looks like when the plates are pressed against each other, the resulting plate deformation that cancels the varying gasket groove depths and the resulting gasket deformation that cancels the varying gasket body thickness. FIGS. 19 and 20 illustrate the same as FIGS. 21 and 22 but for a prior art gasket and two prior art plates. The prior art gasket and plates are not "pre-deformed", which results in an unwanted gasket and plate deformation when the plates are pressed against each other and, consequently, a varying distance between the plates on opposite sides of the gasket.

While the gasket 2 illustrated in FIGS. 8 to 12 is arranged to be positioned between two heat transfer plates 1 according to FIG. 1, a gasket 52 as illustrated in FIG. 13-18 is arranged to be positioned between an outermost heat transfer plate 1 of the plate pack and an end plate of the gasketed plate heat exchanger. The gaskets 2 and 52 are similar in many aspects, why most of the description above, with suitable adjustments, is valid also for the gasket 52. However, there are some differences between the gasket 2 and the gasket 52. For example, the extension of the annular gasket part 4 is different between the gaskets 2 and 52, the annular gasket part 4 of the gasket 52 lacks projections projecting from the gasket body 16, the gasket body 16 of the gasket 52 is similar to half the gasket body 16 of the gasket 2, and the gasket 52 comprises first and third ring gasket parts 54 and 56 besides for the second and fourth ring gasket parts 6 and 8. Hereinafter, the last named difference will be focused on.

Along an inner portion 58 of the first ring gasket part 54, the lower side 20 of the gasket body 16 is inclined an angle, here 2 degrees, in relation to the upper side 18 of the gasket body 16. Thereby, the thickness of the gasket body 16, within the inner portion 58 of the first ring gasket part 54 is linearly gradually increasing in a direction towards an outer portion 60 of the first ring gasket part 54. Within the outer portion 60 of the first ring gasket part 54, the upper and lower sides 18 and 20 of the gasket body 16 extend parallel to each other, so as to give the gasket body 16 an essentially constant thickness along a transverse extension of the gasket body 16. Further, along an inner portion 62 of the third ring gasket part 56, the lower side 20 of the gasket body 16 is inclined an angle, here 2 degrees, in relation to the upper side 18 of the gasket body 16. Thereby, the thickness of the gasket body 16, within the inner portion 62 of the third ring gasket part 56 is linearly gradually increasing in a direction towards an outer portion 64 of the third ring gasket part 56. Within the outer portion 64 of the third ring gasket part 56, the upper and lower sides 18 and 20 of the gasket body 16 extend parallel to each other, so as to give the gasket body 16 an essentially constant thickness along a transverse extension of the gasket body 16. The upper projection 42 extends, inwards offset, along the first and third ring gasket parts 54 and 56, while the lower projection 44 extends, inwards offset, along the inner portions 58 and 62 of the first and third ring gasket parts 54 and 56.

Above, the pressing depth of the heat transfer plate is varied around the portholes such as to achieve ring groove parts having partly inclined bottoms. Further, the design of the gasket is varied such as to achieve a partly radially tapered ring gasket body. Instead of, or in addition to, varying the ring groove part pressing depth and the ring gasket body thickness, the pressing depth and the gasket body thickness may, according to the invention, be varied within other plate areas and gasket areas, respectively. Hereinafter, a heat transfer plate 1 and a gasket 2 according to an alternative embodiment of the invention will be described. This plate and this gasket, which essentially are designed as illustrated in FIGS. 1 and 8, respectively, are in many aspect similar to the above described plate 1 and gasket 2, and much of the description above is valid also for this plate and this gasket. Therefore, to avoid unnecessary repetition, the differences of the alternative embodiment are focused on below.

Figure 23:
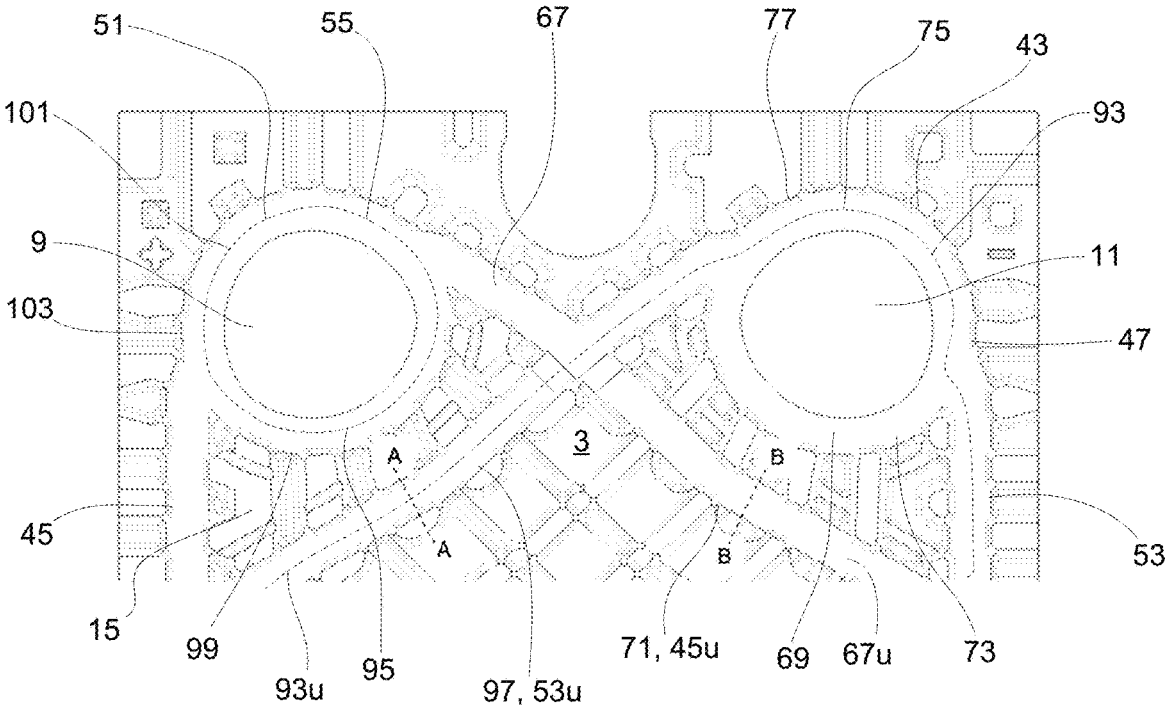
Figure 24:
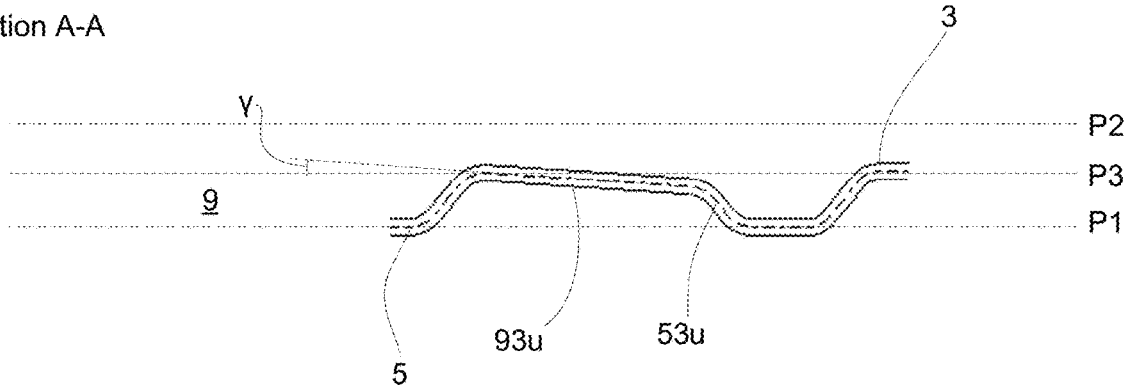
Figure 25:
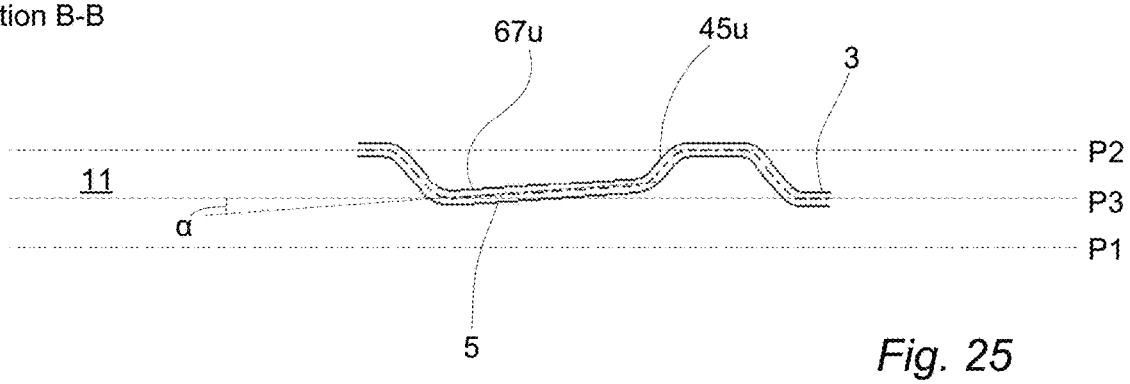
Figure 26:
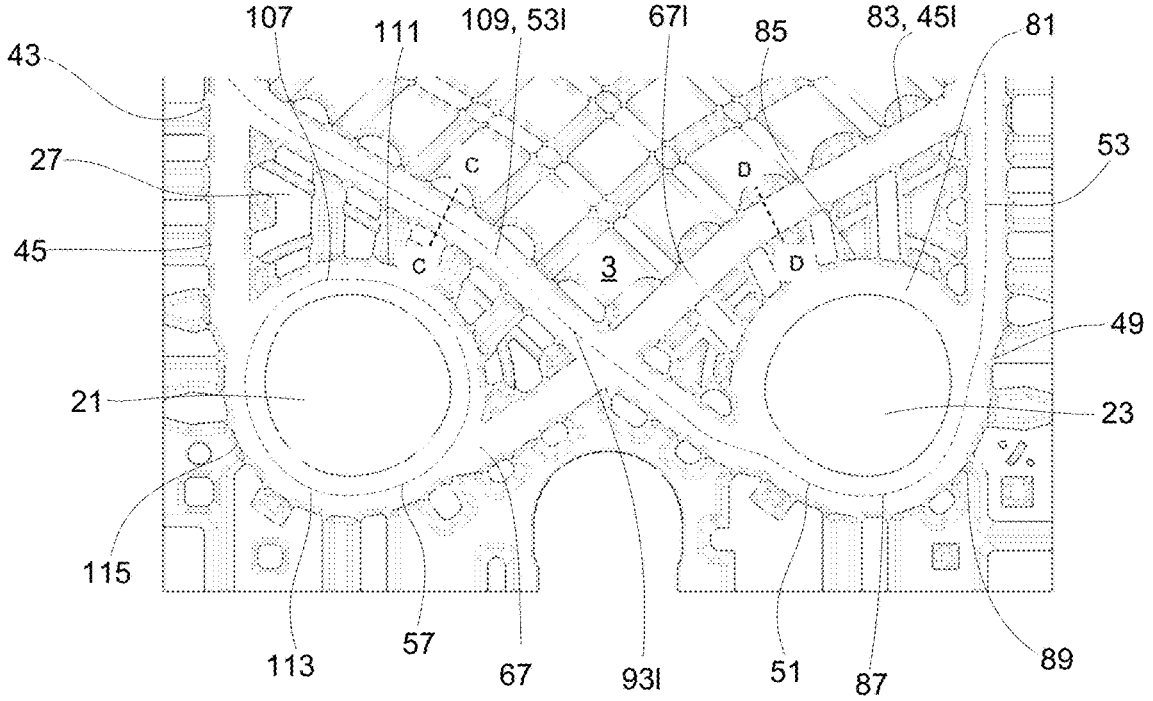
Figure 27:
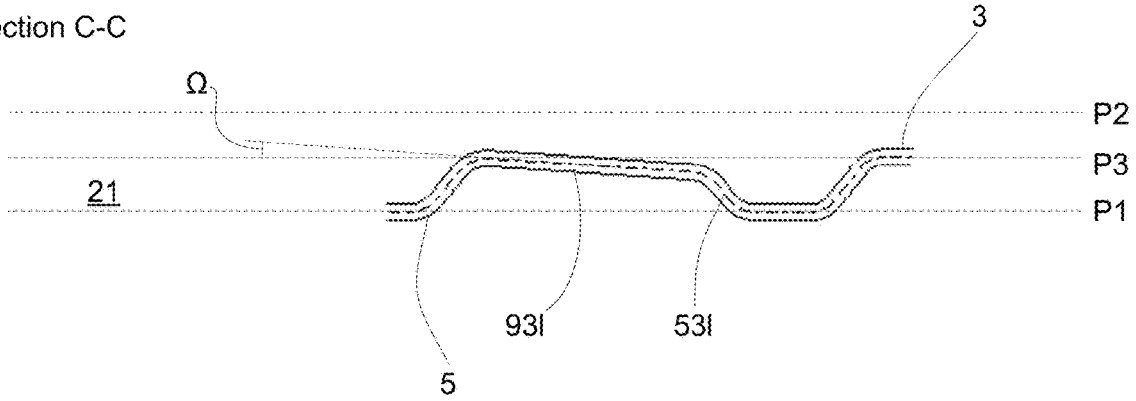
Figure 28:
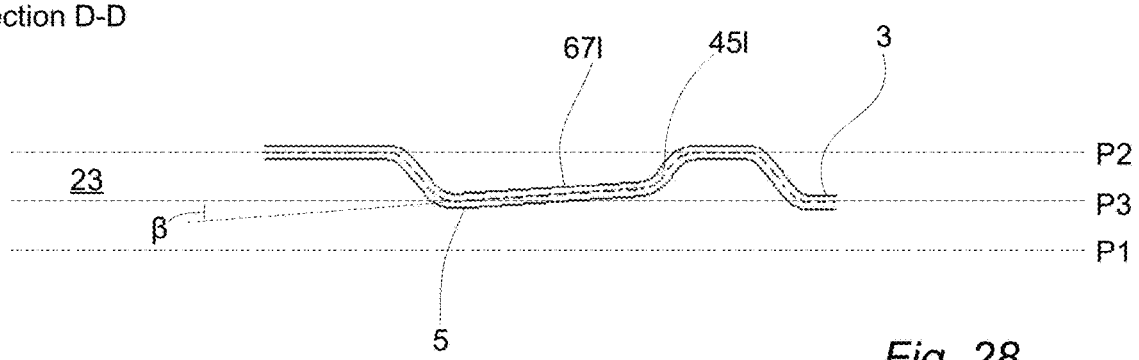

FIGS. 23-28 illustrate the plate 1 according to the alternative embodiment. More particularly, FIGS. 23 and 26 illustrate a front side of the front gasket groove 43, and FIGS. 25 and 28 illustrate local cross sections of the front gasket groove 43. A bottom 67*u* of an upper front groove portion 71 of the front gasket groove 43, here the upper diagonal portion 45*u* of the annular front groove part 45, is plane and inclined an angle $\alpha$, which here equals 4 degrees, in relation to an imaginary plane P3 arranged between the imaginary lower and upper planes P1 and P2. Similarly, a bottom 671 of a lower front groove portion 83 of the front gasket groove 43, here the lower diagonal portion 45*l* of the annular front groove part 45, is plane and inclined an angle $\beta$, which here equals 4 degrees, in relation to the plane P3. Thereby, a depth of the annular front groove part 45, within the upper and lower diagonal portions 45*u* and 45*l* thereof, is linearly gradually increasing in a direction towards the second and fourth portholes 11 and 23. The bottom 67 of the annular front groove part 45 outside the upper and lower diagonal portions 45*u* and 45*l*, and transition portions not illustrated or further discussed herein, is plane and extends in the plane P3 to give the annular front groove part 45 an essentially constant depth along a transverse extension of the front gasket groove 43. Further, bottoms 69 and 75 of inner and outer portions 73 and 77 of the second ring groove part 47, and bottoms 81 and 87 of inner and outer portions 85 and 89 of the fourth ring groove part 49, are plane and extends in the plane P3. Thereby, along the second and fourth ring groove parts 47 and 49, the depth of the front gasket groove 43 is essentially constant along a transverse extension of the front gasket groove 43.

FIGS. 23 and 26 illustrate a back side of the back gasket groove 51, and FIGS. 24 and 27 illustrate local cross sections of the back gasket groove 51. A bottom 93*u* of an upper back groove portion 97 of the back gasket groove 51, here the upper diagonal portion 53*u* of the annular back groove part 53, is plane and inclined an angle γ, which here equals 4 degrees, in relation to the plane P3. Similarly, a bottom 93*l* of a lower back groove portion 109 of the back gasket groove 51, here the lower diagonal portion 53*l* of the annular back groove part 53, is plane and inclined an angle Ω, which here equals 4 degrees, in relation to the plane P3. Thereby, a depth of the annular back groove part 53, within the upper and lower diagonal portions 53*u* and 53*l* thereof, is linearly gradually increasing in a direction towards the first and third portholes 9 and 21. The bottom 93 of the annular back groove part 53 outside the upper and lower diagonal portions 53*u* and 53*l*, and transition portions not illustrated or further discussed herein, is plane and extends in the plane P3 to give the annular back groove part 53 an essentially constant depth along a transverse extension of the back gasket groove 51. Further, bottoms 95 and 101 of inner and outer portions 99 and 103 of the first ring groove part 55, and bottoms 107 and 113 of inner and outer portions 111 and 115 of the third ring groove part 57, are plane and extends in the plane P3. Thereby, along the first and third ring groove parts 55 and 57, the depth of the back gasket groove 51 is essentially constant along a transverse extension of the back gasket groove 51.

Figure 29:
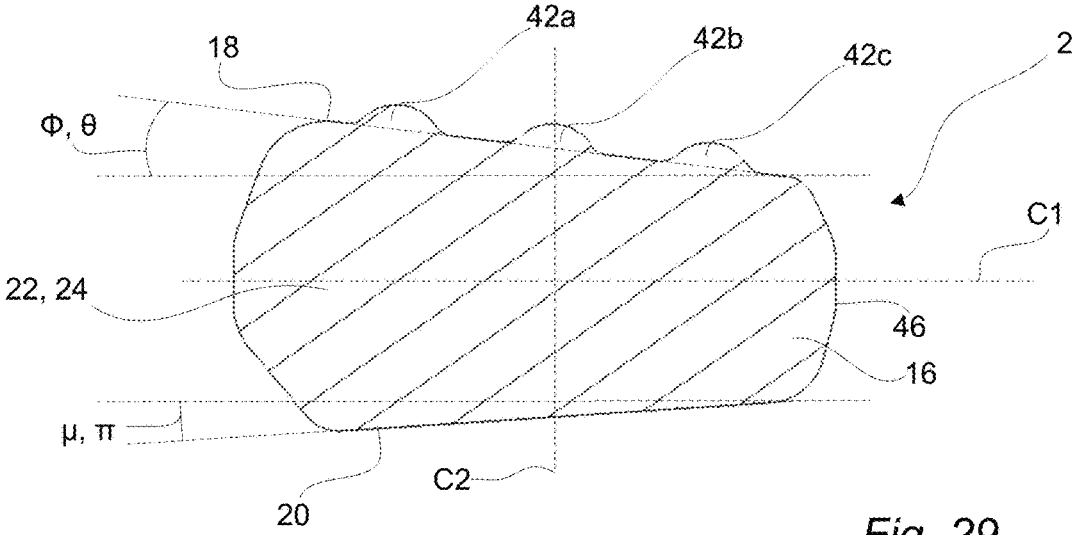
FIG. 29 illustrates a cross section of a gasket according to an alternative embodiment of the invention.
Figure 30:
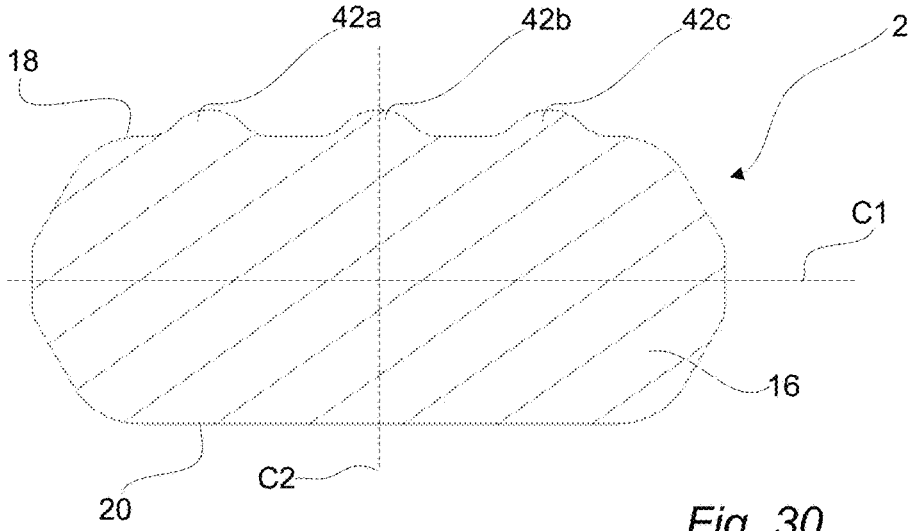
FIG. 30 illustrates another cross section of the gasket according to the alternative embodiment of the invention, and FIG. 31 corresponds to FIG. 22 for plates and gasket according to the alternative embodiments of the invention.

FIGS. 29 and 30 illustrate local transverse cross sections of the gasket 2 according to the alternative embodiment. FIG. 29 illustrate the cross section within upper and lower diagonal portions 22 and 24 of the annular gasket part 4 of the gasket 2, while FIG. 30 illustrate the cross section within essentially the rest of the gasket 2. The design of the gasket 2 illustrated in FIGS. 29 and 30 is adapted to the design of the plate 1 illustrated in FIGS. 23-28, and vice versa. Accordingly, with reference also to FIG. 8, as illustrated in FIG. 29, along an upper gasket portion 26 defining the second intermediate space 10, here the upper diagonal portion 22 of the annular gasket part 4 (non-bold reference numerals in FIG. 8), the upper side 18 of the gasket body 16 is inclined an angle θ, which here equals 6 degrees, in relation to the first center plane C1, while the lower side 20 of the gasket body 16 is inclined an angle μ, which here equals 4 degrees, in relation to the first center plane C1. Similarly, as illustrated in FIG. 29, along a lower gasket portion 34 defining the fourth intermediate space 12, here the lower diagonal portion 24 of the annular gasket part 4 (non-bold reference numerals in FIG. 8), the upper side 18 of the gasket body 16 is inclined an angle ϕ, which here equals 6 degrees, in relation to the first center plane C1, while the lower side 20 of the gasket body 16 is inclined an angle π, which here equals 4 degrees, in relation to the first center plane C1. Thereby, a thickness of the gasket body 16, within the upper and lower diagonal portions 22 and 24 of the annular gasket part 4, is linearly gradually increasing in a direction towards the second and fourth ring gasket parts 6 and 8 (FIG. 8). As illustrated in FIG. 30, outside the upper and lower diagonal portions 22 and 24, and transition portions not illustrated or further discussed herein, of the annular gasket part 4, the upper and lower sides 18 and 20 of the gasket body 16 extend parallel to each other, and to a first center plane C1 of the gasket body 16, to give the gasket body 16 an essentially constant thickness along a transverse extension of the gasket body 16. Further, along the second and fourth ring gasket parts 6 and 8, the upper and lower sides 18 and 20 of the gasket body 16 extend parallel to each other, and to the first center plane C1 of the gasket body 16, to give the gasket body 16 an essentially constant thickness along a transverse extension of the gasket body 16.

Besides for the body 16, the gasket 2 according to the alternative embodiment further comprises three elongate upper projections 42*a*, 42*b* and 42*c* projecting from the upper side 18 of the body 16, and no projection projecting from the lower side 20 of the body 16. The upper projections 42*a*, 42*b* and 42*c* extend along each other and along the complete extension of body 16. One of the upper projections 42*b* is arranged aligned with a second center plane C2 of the gasket body 16, while the remaining two upper projections 42*a* and 42*c* are arranged on opposite sides of the upper projection 42*b*.

Figure 31:
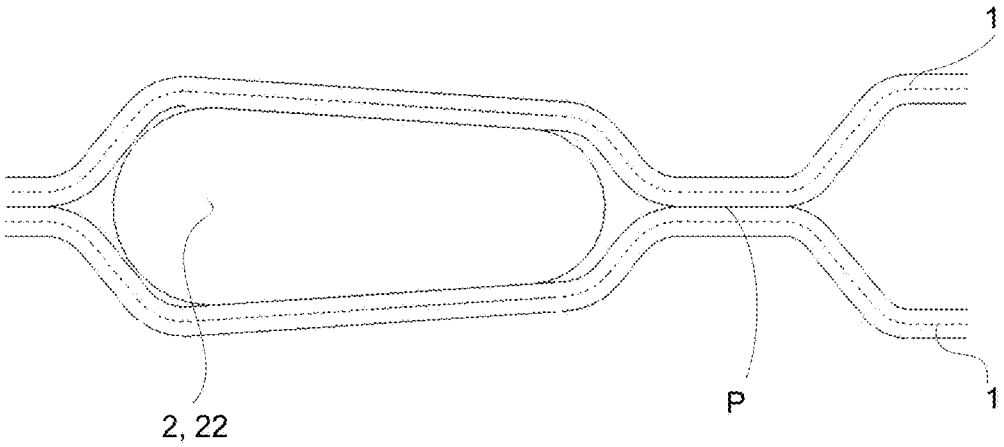

FIG. 31 illustrates what it looks like, in cross section at the upper diagonal portion 22 of the gasket 2 according to the alternative embodiment, when the gasket 2 is pressed between two heat transfer plates 1 according to the alternative embodiment, with one of the heat transfer plates being rotated in relation to the other heat transfer plate. Then, with reference to FIGS. 8, 23 and 26, the upper diagonal portion 22 of the gasket 2 is arranged between the upper diagonal portion 45*u* of the annular front groove part 45 of the front gasket groove 43 of the lower heat transfer plate 1, and lower diagonal portion 53*l* of the annular back groove part 53 of the back gasket groove 51 of the upper heat transfer plate 1. The inclined gasket groove bottoms and the tapered gasket body which exist before, and remain after, pressing may guarantee the contact between the two heat transfer plates in the desired contact areas, especially at point P where the risk of plate separation is particularly high due to media pressure inside a channel formed between the heat transfer plates.

The above described embodiments of the present invention should only be seen as examples. A person skilled in the art realizes that the embodiments discussed can be varied and combined in a number of ways without deviating from the inventive conception.

In the above described embodiments, the upper and lower sides 18 and 20 of the gasket body 16 are both inclined within the upper and lower gasket portions 26 and 34 of the gasket 2 to achieve the varying thickness of the gasket body 16. Naturally, a varying body thickness may instead be achieved by having only one of the upper and lower sides 18 and 20 inclined.

Further, in the above described embodiments, the upper and lower sides of the gasket body are inclined with the same angle/angles within the upper and lower gasket portions of the gasket. This need not be the case in alternative embodiments.

In the above described embodiments, the bottoms of the upper and lower front groove portions and the bottoms of the upper and lower back groove portions are all inclined to achieve a varying groove depth. According to an alternative embodiment, only the bottoms of either the upper and lower front groove portions or the upper and lower back groove portions are inclined.

Further, in the above described embodiments, the bottoms of the upper and lower front groove portions and the bottoms of the upper and lower back groove portions are all inclined with the same angle. This need not be the case in alternative embodiments.

The imaginary plane P3 used above to define gasket groove depth may or may not be arranged half way between the planes P1 and P2. According to alternative embodiments, the plane P3 may also coincide with the imaginary lower plane P1.

The borders of the upper and lower front groove portions, the upper and lower back groove portions and the upper and lower gasket portions may be endlessly varied so as to reposition, reduce or expand the areas within which the groove depth and the gasket body thickness are varied. As an example, the groove depth and the gasket body thickness could be varied within the complete ring groove parts and ring gasket parts, respectively.

The number, extension, design and/or positioning of upper and lower projections of the gasket could be varied endlessly.

In the above described embodiments, the heat transfer plates of the plate pack and the gaskets between the heat transfer plates are all similar, but this is not mandatory. As an example, in an alternative plate pack, plates of different types may be combined, such as plates having differently configurated heat transfer patterns.

The heat transfer plate need not be rectangular but may have other shapes, such as essentially rectangular with rounded corners instead of right corners, circular or oval. The portholes of the plates may have other forms than illustrated in the drawings, such as a circular form. The heat transfer plate need not be made of stainless steel but could be of other materials, such as titanium or aluminium. Similarly, the gaskets need not be made of rubber.

The inventive heat transfer plate could be used in connection with other types of plate heat exchangers than gasketed ones, for example semi-welded plate heat exchangers. Further, the plates in the plate pack could be "flipped" instead of "rotated" in relation to each other.

The heat transfer plate need not be provided with a heat transfer pattern of herringbone type and distribution patterns of chocolate type but could be provided with other patterns, both symmetric and asymmetric patterns.

It should be stressed that the attributes front, back, upper, lower, first, second, third, etc. is used herein just to distinguish between details and not to express any kind of orientation or mutual order between the details.

Further, it should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate comprising an upper end portion, a center portion and a lower end portion arranged in succession along a longitudinal center axis of the heat transfer plate, the upper end portion comprising a first and a second porthole and an upper distribution area provided with an upper distribution corrugation pattern, the lower end portion comprising a third and a fourth porthole and a lower distribution area provided with a lower distribution corrugation pattern, and the center portion comprising a heat transfer area provided with a heat transfer corrugation pattern differing from the upper and lower distribution corrugation patterns, wherein the heat transfer plate further comprises, on a front side thereof, a front gasket groove including an annular front groove part extending around the heat transfer area, the upper and lower distribution areas, and the first and third portholes, a second ring groove part enclosing the second porthole and a fourth ring groove part enclosing the fourth porthole, wherein the upper end portion further comprises a second adiabatic area extending between the annular front groove part and the second ring groove part and the lower end portion further comprises a fourth adiabatic area extending between the annular front groove part and the fourth ring groove part, an upper front groove portion of the front gasket groove extending between the second porthole and the upper distribution area and comprising a bottom, and a lower front groove portion of the front gasket groove extending between the fourth porthole and the lower distribution area and comprising a bottom, the bottom of the upper front groove portion of the front gasket groove comprising first and second halves, the first half of the bottom of the upper front groove portion of the front gasket groove being positioned closer to the second adiabatic area than the second half of the bottom of the upper front groove portion of the front gasket groove, wherein the bottom of the upper front groove portion is inclined such that a depth of the front gasket groove, within the upper front groove portion, increases in a direction towards the second adiabatic area and is maximum within the first half of the bottom of the upper front groove portion of the front gasket groove, and the bottom of the lower front groove portion is inclined such that a depth of the front gasket groove, within the lower front groove portion, increases in a direction towards the fourth adiabatic area.

2. A heat transfer plate according to claim 1, wherein the heat transfer plate further comprises, on a back side thereof, a back gasket groove including an annular back groove part extending around the heat transfer area, the upper and lower distribution areas, and the second and fourth portholes, a first ring groove part enclosing the first porthole and a third ring groove part enclosing the third porthole, wherein the upper end portion further comprises an first adiabatic area extending between the annular back groove part and the first ring groove part and the lower end portion further comprises a third adiabatic area extending between the annular back groove part and the third ring groove part, an upper back groove portion of the back gasket groove extending between the first porthole and the upper distribution area and comprising a bottom, and a lower back groove portion of the back gasket groove extending between the third porthole and the lower distribution area and comprising a bottom, wherein the bottom of the upper back groove portion is inclined such that a depth of the back gasket groove, within the upper back groove portion, increases in a direction towards the first adiabatic area, and the bottom of the lower back groove portion is inclined such that a depth of the back gasket groove, within the lower back groove portion, increases in a direction towards the third adiabatic area.

3. A heat transfer plate according to claim 1, wherein the depth of the front gasket groove, within the upper front groove portion and the lower front groove portion, is gradually increasing along a transverse extension of the upper and lower front groove portions of the front gasket groove.

4. A heat transfer plate according to claim 1, wherein the bottom of the upper front groove portion and the bottom of the lower front groove portion are plane.

5. A heat transfer plate according to claim 1, wherein said upper front groove portion of the front gasket groove is comprised in an upper diagonal portion of the annular front groove part of the front gasket groove, which upper diagonal portion extends between the second adiabatic area and the upper distribution area, and said lower front groove portion of the front gasket groove is comprised in a lower diagonal portion of the annular front groove part of the front gasket groove, which lower diagonal portion extends between the fourth adiabatic area and the lower distribution area.

6. A heat transfer plate according to claim 1, wherein said upper front groove portion of the front gasket groove is comprised in an inner portion of the second ring groove part of the front gasket groove, which inner portion extends between the second porthole and the second adiabatic area, and said lower front groove portion of the front gasket groove is comprised in an inner portion of the fourth ring groove part of the front gasket groove, which inner portion extends between the fourth porthole and the fourth adiabatic area.

7. A heat transfer plate according to claim 1, wherein a bottom of the second ring groove part comprises an annular second inner edge defining the second porthole, and a bottom of the fourth ring groove part comprises an annular fourth inner edge defining the fourth porthole.

8. A gasket for a plate heat exchanger comprising an annular gasket part, an annular second ring gasket part and an annular fourth ring gasket part, the second and fourth ring gasket parts being arranged outside, and on opposite sides of, the annular gasket part, the second ring gasket part and the annular gasket part being separated by a second intermediate space and the fourth ring gasket part and the annular gasket part being separated by a fourth intermediate space, an upper gasket portion of the gasket limiting the second intermediate space and a lower gasket portion of the gasket limiting the fourth intermediate space, wherein the gasket comprises a body extending along the complete annular, second ring and fourth ring gasket parts and comprising an upper side and an opposing lower side, which upper and lower sides define a thickness of the body, the body of the gasket within the upper gasket portion comprising first and second halves, the first half of the body of the gasket within the upper gasket portion being positioned closer to the second intermediate space than the second half of the body of the gasket within the upper gasket portion, wherein the thickness of the body of the gasket, within the upper gasket portion, increases in a direction towards the second intermediate space such that it is maximum within the first half of the body of the gasket within the upper gasket portion and, within the lower gasket portion, increases in a direction towards the fourth intermediate space.

9. A gasket according to claim 8, wherein the thickness of the body of the gasket, within the upper gasket portion and the lower gasket portion, is gradually increasing along a transverse extension of the upper and lower gasket portions of the gasket.

10. A gasket according to claim 8, wherein the upper and lower sides of the body are essentially plane.

11. A gasket according to claim 8, wherein said upper gasket portion of the gasket is comprised in an upper diagonal portion of the annular gasket part of the gasket, which upper diagonal portion extends on an inside of the second ring gasket part of the gasket, and said lower gasket portion of the gasket is comprised in a lower diagonal portion of the annular gasket part of the gasket, which lower diagonal portion extends on an inside of the fourth ring gasket part of the gasket.

12. A gasket according to claim 8, wherein said upper gasket portion of the gasket is comprised in an inner portion of the second ring gasket part of the gasket, which inner portion extends between an outer portion of the second ring gasket part of the gasket and an upper diagonal portion of the annular gasket part of the gasket, which upper diagonal portion extends on an inside of the second ring gasket part of the gasket, and said lower gasket portion of the gasket is comprised in an inner portion of the fourth ring gasket part of the gasket, which inner portion extends between an outer portion of the fourth ring gasket part of the gasket and a lower diagonal portion of the annular gasket part of the gasket, which lower diagonal portion extends on an inside of the fourth ring gasket part of the gasket.

13. A gasket according to claim 8, wherein the gasket further comprises at least one elongate projection projecting from one of the upper side and the lower side of the body and extending along at least the upper and lower gasket portions of the gasket.

14. A gasket according to claim 13, wherein said at least one elongate projection is arranged offset from a second center plane of the body.

15. A gasket according to claim 13, wherein the second center plane of the body of the gasket is arranged between said at least one projection and the second intermediate space within the upper gasket portion, and between said at least one projection and the fourth intermediate space within the lower gasket portion.

* * * * *